United States Patent [19]

Habib

[11] 4,144,027

[45] Mar. 13, 1979

[54] PRODUCT AND PROCESS

[75] Inventor: Emile E. Habib, Spartanburg, S.C.

[73] Assignee: Milliken Research Corporation, Spartanburg, S.C.

[21] Appl. No.: 826,771

[22] Filed: Aug. 22, 1977

Related U.S. Application Data

[63] Continuation of Ser. No. 269,897, Jul. 7, 1972, abandoned, which is a continuation of Ser. No. 292,776, Jul. 3, 1963, abandoned, which is a continuation-in-part of Ser. No. 230,710, Oct. 15, 1962, abandoned.

[51] Int. Cl.[2] ..... D06M 13/18; D06M 13/42

[52] U.S. Cl. ..... 8/127.6; 8/128 R; 8/128 A; 427/390 R; 428/270

[58] Field of Search ..... 8/127.6, 128 R, 128 A; 427/390 R; 428/270

[56] References Cited

U.S. PATENT DOCUMENTS 3,152,920 10/1964 Caldwell et al. ..... 8/127.6

*Primary Examiner*—John Kight, III

*Attorney, Agent, or Firm*—Glen M. Burdick; H. William Petry

[57] ABSTRACT

This invention relates to a process for modifying the characteristics of structures containing keratin fibers and, more particularly, to processes for reducing the relaxation and felting shrinkage of a structure containing keratin fibers and for setting said fibers in a given configuration if desired, and to the structures so improved.

23 Claims, No Drawings

PRODUCT AND PROCESS

This application is a continuation of copending application Ser. No. 269,897, filed July 7, 1972, now abandoned, which is a continuation of my copending U.S. patent application, Ser. No. 292,776, filed July 3, 1963, now abandoned, which is a continuation-in-part of my copending U.S. patent application, Ser. No. 230,710, filed Oct. 15, 1962, now abandoned.

The relaxation and felting shrinkages of structures containing keratin fibers have been a serious problem in the textile industry. The considerable amount of research and development has resulted in several methods that will inhibit the felting shrinkage of these structures. No method, however, has been developed prior to this invention for the control of relaxation shrinkage. The most widely used process to date involves digestion of the fiber scales by chlorination. A similar effect is obtained by use of acid/permanganate. Both of these methods, however, are objectionable because of the loss of tensile strength and abrasion resistance which results from degradation of the fibers. Furthermore, fabrics treated by these methods must be made to higher weights so that after the degradative action, sufficient strength remains in the structure to meet minimum wear requirements. The combination of degradation plus weight loss during the processing results in the necessity for using more wool and, therefore, a higher cost of product.

A considerable amount of research has been conducted to circumvent the degradative action of chlorination and other oxidative methods. This research has produced several procedures which are not as widely used at the present time. One method consists of depositing on the surface of the keratin fiber a polymeric material as, for example, a polyamide-type polymer. In this method, the fabric is passed through a solution of a diamine and then treated with a salt of a dibasic acid; the polyamide is thus formed at the interface between the diamine and the salt of the dibasic acid to form a coating on the fiber.

While adequate shrinkproofing is effected in this manner, there are several objectionable features to this process. In the first place, dye migration caused by the diamine limits seriously the type of dyes that may be used in this process and, consequently, the range of colors which may be used. Also, the fabric resulting from this process has a harsh hand and is deficient in its draping characteristics, thus the character of the fabric is seriously affected. The relaxation shrinkage is not adequately inhibited.

Other polymeric resins designed to form a film on the keratin fibers have also been developed. Combinations of polyamides with epoxys and/or acrylates have been used; also polyesters which have been made to high molecular weight to obtain flexibility have been used in conjunction with peroxide curing agents. These processes also produce fabrics which have a harsh hand and poor drape when the amounts of these modifying materials are such as to inhibit the shrinkage to the required amount. The relaxation shrinkage is also not adequately inhibited.

Another process has been developed for inhibiting the shrinkage of structures containing keratin fibers by use of isocyanates. To obtain sufficient reaction, using isocyanates alone, to render the fabric being treated resistant to shrinkage, long refluxing conditions are required, which makes this process commercially impracticable. Furthermore, to obtain the desired resistance to shrinkage, large amounts of the isocyanate compounds must be added to the fibers which results in a fabric that is both harsh and stiff, having a hand more like horsehair than wool.

Relaxation and felting shrinkage properties are not the only problems associated with fabrics containing keratin fibers. Such fabrics are also characterized by a low degree of configurational stability, particularly when subjected to moisture. For example, the crease in a pair of wool trousers is virtually eliminated by wetting. The same is true of the lustrous finish applied to wool fabrics in a typical textile finishing operation.

To overcome these difficulties, durable configurations have been imparted to such fabrics through the use of a wide variety of reducing agents. According to these prior art processes, the fabric is impregnated with the reducing agent, whereupon some of the cystine disulfide linkages of the keratin fiber molecule are ruptured. The resulting fabric, in a reduced condition, can be heat-pressed, generally in the presence of large quantities of moisture, into configurations which are substantially durable to subsequent wetting. These procedures, particularly as improved by the addition of certain compounds which obviate the use of large quantities of moisture during pressing, have been highly successful because of the desirable properties imparted to fabrics so treated.

These processes, however, are degradative processes and, therefore, the physical properties of the resulting fabrics are generally diminished. Furthermore, the reduced keratin fibers have a characteristic, unpleasant odor regardless of the reducing agent utilized. Additives have been developed which eliminate this odor, but such techniques invariably increase the cost of the process.

Although present processes for setting keratin fibers in durable configurations have been developed to practicable levels, it would be highly desirable if a process could be developed which enhanced, rather than degraded, physical properties and which avoided the unpleasant odor of reduced keratin fibers without the use of costly additives. Even more desirable would be a process which resolved these problems while providing a fabric, treated at the mill level, which is presensitized for subsequent durable setting, by the garment manufacturer, in the absence of large quantities of water.

The difficulties associated with the above prior art processes are overcome in accordance with the teachings of the copending application Ser. No. 230,712, wherein a monomeric polyfunctional compound is applied to keratin structures in combination with a polyfunctional isocyanate. While the process of the above application is entirely suitable for textile operations, the handle of fabrics is improved in the practice of the present invention which comprises reacting the keratin fibers with a polyfunctional isocyanate in combination with a polymeric polyhydroxy compound. To set the fibers in a given configuration, it is required only that the fibers be maintained in the desired configuration during this reaction.

The process of this invention requires the use of relatively small amounts of material to obtain the required stabilization and/or settability. The process of application is a simple one involving impregnating the keratin fibers by any conventional technique such as padding, immersing, spraying or the like, followed by drying and curing of the components on the fibers. These steps may be run in tandem on equipment that is available in textile plants.

The products of this invention not only are superior in almost every instance to those treated by other known methods but also are superior to the same fabric prior to treatment. In the process of this invention there is no degradative action on the wool fiber; on the contrary, improvements in strengths and abrasion resistance are obtained over the untreated controls. It has also been found that more uniform dyeing may be accomplished on keratin fibers treated in accordance with this invention than those treated by the degradative processes of the prior art.

A particular advantage in the practice of this invention is the virtual elimination of the relaxation shrinkage of the fabric, which is a highly desirable property in that it is not necessary that the fabric be preshrunk prior to cutting into garments as is required in the processes of the prior art. This results in savings of both labor and material since yardage is always lost when the fabric is relaxed prior to cutting into garments.

The process also allows the manufacture of lighter weight garments which are washable without felting shrinkage which has not been possible in processes of prior art. Besides the savings in wool, it is often highly desirable to have lighter weight fabrics available for the production of more comfortable garments.

Fabrics which have been treated by the process of this invention may be made to any desired hand and/or drape depending upon the end use requirements. This may be accomplished by balancing construction of the fabric with the amount of pickup of treating compound used in the system. Although lightweight fabrics may be made with a high degree of drape and a soft pleasant hand, the increased resilience produced in fabrics treated in accordance with this invention gives the fabric a more substantial feel, whereas the untreated lightweight fabrics of the same constructions respectively feel flimsy and unsubstantial.

Many other advantages will become apparent to those practicing the processes of this invention.

One embodiment of this invention comprises forming a pre-polymer from the polyfunctional isocyanate and polymeric polyhydroxy compound, applying the pre-polymer to the structure containing keratin fibers (with or without coreactant as hereinafter set forth) and curing the pre-polymer on the fibers.

By "pre-polymer" as used herein is meant the reaction product of the polyfunctional isocyanate and polymeric polyhydroxy compound carried to an extent below which a gel is produced which is insoluble in one of the organic solvents, particularly the chlorinated hydrocarbons, hereinafter set forth.

In preparing the pre-polymers of this invention, at least equimolar amounts of the polyfunctional isocyanate and polymeric polyhydroxy compound are utilized, although a small molar excess is preferably utilized. Generally, a molar excess of about 1.1 to 1.0 of —N=C=X groups of the polyfunctional isocyanate to total —OH groups is present.

It is generally preferred to have a small amount of water present during formation of the pre-polymer.

The amount of water added should be less than that amount which would cause gelation of the pre-polymer. Generally, no more than about 0.5% of water based on the weight of polymeric polyhydroxy compound is required to provide the desired effect.

In a more preferred practice of this embodiment of the invention, an additional amount of polyfunctional isocyanate is added to the pre-polymer system after polymerization. This additional isocyanate increases the stability of the pre-polymer, reacts with regain water in the wool and thereby enhances the reaction of the pre-polymer with keratin fibers. It has been found, however, that shrinkage inhibition is obtained with the pre-polymers of this invention even though there is present an excess of active hydrogen atoms from extraneous water, water in the structures containing keratin fibers, and from the added coreactants which will be described hereinafter. For example, a molar ratio of —N=C=X groups to total active hydrogen atoms as low as about 0.6 provides some improvement in inhibiting shrinkage in structures containing keratin fibers or enabling one to set such fibers. While improvement is noted at molar ratios of —N=C=X to total active hydrogen atoms below about 1, substantially more pre-polymer is required to obtain sufficiently low shrinkage values or a sufficiently high degree of settability. When this ratio exceeds about 1, however, reduced amounts, for example, as low as a few percent (2-5% depending on the particular fabric) of the pre-polymer may be utilized to produce commercially acceptable levels of low shrinkage.

In another embodiment of this invention, the polyfunctional isocyanate and polymeric polyhydroxy compound, preferably along with one of the well-known catalysts for the reaction of active hydrogen atoms with isocyanates, may be applied to the structure containing keratin fibers from a solution in a non-reactive solvent directly, i.e., without first preparing a pre-polymer as set forth above. In obviating the production of a pre-polymer, the expense and control problems associated therewith are eliminated.

Although some improvement is noted when the polyfunctional isocyanate, polymeric polyhydroxy compound, coreactant if added, and catalyst are present in amounts sufficient to provide a molar ratio of —N=C=X to total active hydrogen atoms of at least about 0.4, best results are obtained at higher ratios, for example, greater than about 1. As in the pre-polymer embodiment of this invention, shrinkage inhibition at commercial levels is obtained with less reactants at higher molar ratios of —N=C=X to total active hydrogen atoms.

In the practice of this embodiment of the invention, it is preferred to react the polyfunctional isocyanate and polymeric polyhydroxy compound, with or without a coreactant as hereinafter set forth, with the keratin fibers of the structure being treated in the presence of catalyst. Any of the well-known catalysts for the reaction of active hydrogen atoms with isocyanates may be used. Of these catalysts, which are used in the production of polyurethanes, the organo-tin compounds are preferred, particularly stannous octoate.

Among the classes of catalysts which can be used, there are included the inorganic and organic bases such as sodium hydroxide, sodium methylate, sodium phenolate, tertiary amines and phosphines. Particularly suitable amine catalysts include 2,2,1-diazabicyclo-octane, trimethylamine, 1,2-dimethylimidazole, triethylamine, diethyl cyclohexylamine, dimethyl long-chain $C_{12}$ to $C_{18}$ amines, dimethylaminoethanol, diethylaminoethanol, N-methyl morpholine, N-ethyl morpholine, triethanolamine and the like. Other suitable catalysts include arsenic trichloride, antimony trichloride, antimony pentachloride, antimony tributoxide, bismuth trichloride, titanium tetrachloride, bis(cyclopentadienyl) titanium difluoride, titanium chelates such as octylene glycol titanate, dioctyl lead dichloride, dioctyl lead diacetate, dioctyl lead oxide, trioctyl lead chloride, trioctyl lead hydroxide, trioctyl lead acetate, copper chelates such as copper acetylacetonate, and mercury salts.

Organo-tin compounds characterized by at least one direct carbon to tin valence bond are also suitable as catalysts.

Among the many types of tin compounds having carbon to tin bonds, of which specific representative compounds have been tested and shown to be active, are tin compounds having the general formulae set forth on the following page:

(a) $R_3SnX$
(b) $R_2SnX_2$
(c) $RSnX_3$
(d) $R_2SnY$
(e) $RSnOOR'$
(f) $R(SnOOR')_2$

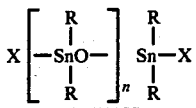

(g)

$R_2Sn(YRX)_2$ (h)

in which the R's represent hydrocarbon or substituted hydrocarbon radicals such as alkyl, aralkyl, aryl, alkaryl, alkoxy, cycloalkyl, alkenyl, cycloalkenyl, and analogous substituted hydrocarbon radicals, the R's represent hydrocarbon or substituted hydrocarbon radicals such as those designated by the R's or hydrogen or metal ions, the X's represent hydrogen, halogen, hydroxyl, amino, alkoxy, substituted alkoxy, acyloxy, substituted acyloxy, acyl radicals or organic residues connected to tin through a sulfide link, and the Y's represent chalcogens including oxygen and sulfur.

Among the compounds of group (a) that deserve special mention are trimethyltin hydroxide, tributyltin hydroxide, trimethyltin chloride, trimethyltin bromide, tributyltin chloride, trioctyltin chloride, triphenyltin chloride, tributyltin hydride, triphenyltin hydride, triallyltin chloride, and tributyltin flouride.

The compounds in group (b) that deserve particular mention and are representative of the group include dimethyltin diacetate, diethyltin diacetate, dibutyltin diacetate, dioctyltin diacetate, dilauryltin diacetate, dibutyltin dilaurate, dibutyltin maleate, dimethyltin dichloride, dibutyltin dichloride, dioctyltin dichloride, diphenyltin dichloride, diallyltin dibromide, diallyltin diiodide, bis(carboethoxymethyl)-tin diiodide, dibutyltin dimethoxide, dibutyltin dibutoxide, $(C_4H_9)2Sn[OCH_2(CH_2OCH_2)_{x-1}CH_2OCH_3]_2$ (in which x is a positive integer), dibutyl-bis(O-acetylacetonyl]-tin, dibutyltin-bis(thiododecoxide), and

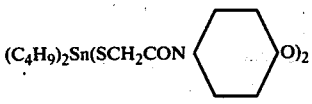

all readily prepared by hydrolysis of the corresponding dihalides. Many commercially available compounds used as stabilizers for vinyl resins are also included in this group.

Among the compounds that are representative of group (c) are butyltin trichloride, octyltin trichloride, butyltin triacetate and octyltin tris(thiobutoxide).

Typical among the compounds of group (d) are dimethyltin oxide, diethyltin oxide, dibutyltin oxide, dioctyltin oxide, dilauryltin oxide, diallyltin oxide, diphenyltin oxide, dibutyltin sulfide, $[HOOC(CH_2)_5]_2SnO$, $[CH_3OCH_2(CH_2OCH_2)_{x-1}CH_2]_2SnO$ and $[CH_3OCH_2(CH_2OCH_2)_{x-1}CH_2O(CH_2)_5]_2SnO$ (in which the x's are positive integers).

Methylstannonic acid, ethylstannonic acid, butylstannonic acid, octylstannonic acid, $HOOC(CH_2)_5$—SnOOH, $(CH_3)_3{}^{\oplus}N(CH_2)_5SnOOH$ $CH_3OCH_2(CH_2OCH_2)_{x-1}CH_2SnOOH$ and $CH_3OCH_2(CH_20CH_2)_{x-1}CH_2O(CH_2)_5SnOOH$ are examples of group (e) catalysts and group (f) catalysts are represented by $HOOSn(CH_2)_xSnOOH$ and $HOOSnCH_2(CH_2OCH_2)_xCH_2SnOOH$ the x's being positive integers.

Typical compounds in group (g) include compounds as poly (dialkyltin oxides) such as dibutyltin basic laurate and dibutyltin basic hexoxide.

Other compounds that are efficient catalysts are those of group (h), of which the organo-tin compounds used as heat and light stabilizers for chlorinated polymers and available under the trade names Advastab 17-M (a dibutyl tin compound believed to contain two sulfur-containing ester groups), Advastab T-50-LT (a dibutyl tin compound believed to contain two ester groups), are typical, as well as many other organotin compounds available under such trade names as "Advastab," "Nuostabe" and "Thermolite."

Of the organo-tin compounds, stannous octoate is preferred for availability.

In another embodiment of this invention, the reaction between the isocyanate/polymeric hydroxy compound system or the pre-polymers thereof and the keratin fibers is considerably enhanced when conducted in the presence of a coreactant having at least two groups containing at least one active hydrogen atom, as determined by the Zerewitinoff method. (Zerewitinoff, Ber., 40, 2023 (1907); Ber., 41, 2236 (1908); Kohler, J. Am. Chem. Soc., 49, 3181 (1927). These materials contain at least two groups, or combinations thereof, such as —OH,—$NH_2$,—NRH,—COOH,—SH or groups which react similarly under reaction conditions.

Suitable polyol coreactants for use in accordance with this invention include the polymeric polyhydroxy compounds noted below, as well as polyols such as ethylene glycol, propylene glycol, trimethylene glycol, 1,2-butylene glycol, 1,3-butane diol, 1,4-butanediol, 1,5-pentane diol, 1,2-hexylene glycol, 1,10-decane diol, 1,2-cyclohexane diol, 2-butene-1,4 diol, 3-cyclohexene-1,1-dimethanol, 4-methyl-3-cyclohexene-1,1-dimethanol, 3-methylene-1,5-pentanediol, 3,2-hydroxyethyl cyclohexanol, 2,9-para-menthanediol, 2,2,4-trimethyl-1,3-pentanediol, 2,5-dimethyl-2,5-hexane diol and the like; alkylene oxide modified diols such as diethylene glycol, (2-hydroxyethoxy)-1-propanol, 4-(2-hydroxyethoxy)-1-butanol, 5-(2-hydroxyethoxy)-1-pentanol, 3-

(2-hydroxypropoxy)-1-propanol, 4-(2-hydroxypropoxy)-1-butanol, 5-(2-hydroxypropoxy)-1-pentanol, 1-(2-hydroxyethoxy)-2-butanol, 1-(2-hydroxyethoxy)-2-pentanol, 1-(2-hydroxymethoxy)-2-hexanol, 1-(2-hydroxyethoxy)-2-octanol, and the like.

Representative examples of ethylenically unsaturated low molecular weight diols include 3-allyloxy-1,5-pentanediol;
3-allyloxy-1,2-propanediol; 2-allyloxymethyl-2-methyl-1,3-propanediol;
2-methyl-2-[(4-pentenyloxy)methyl]-1,3-propanediol; and
3-(o-propenylphenoxy)-1,2-propanediol.

Representative examples of low molecular weight polyols having at least 3 hydroxyl groups include:

glycerol; 1,2,6-hexanetriol;
1,1,1-trimethylolpropane; 1,1,1-trimethylolethane; pentaerythritol;
3-(2-hydroxyethoxy)-1,2-propanediol; 3-(2-hydroxypropoxy)-1,2-propanediol;
6-(2-hydroxypropoxy)-1,2-propanediol; 2-(2-hydroxyethoxy)-1,2-hexanediol;
6-(2-hydroxypropoxy)-1,2-hexanediol;
2,4-dimethyl-2-(2-hydroxyethoxy)methylpentanediol-1,5; mannitol;
galactitol; talitol; iditol; allitol; altritol; guilitol; arabitol; ribitol;
xylitol; lyxitol; erythritol; threitol; 1,2,5,6-tetrahydroxyhexane;
meso-inositol; sucrose, glucose; galactose; mannose; fructose; xylose;
arabinose; dihydroxyacetone; glucose-α-methylglucoside;
1,1,1-tris[(2-hydroxyethoxy)methyl]ethane and
1,1,1-tris[(2-hydroxypropoxy)methyl]propane.

There may also be utilized low molecular weight polyalkyleneether glycols such as tetraethyleneether glycol, triethyleneether glycol, tritetramethyleneether glycol, ditetramethyleneether glycol and the like.

Exemplary diphenylol compounds include 2,2-bis(-phydroxyphenyl) propane; bis(p-hydroxyphenyl) methane and the various diphenols and diphenylol methanes disclosed in U.S. Pat. Nos. 2,506,486 and 2,744,882, respectively.

Exemplary triphenylol compounds which can be employed include the alpha, alpha, omega, tris(hydroxyphenyl)alkanes such as 1,1,3-tris(hydroxyphenyl)ethane; 1,1,3-tris(hydroxyphenyl)propane;
1,1,3-tris(hydroxy-3-methylphenyl)propane;
1,1,3-tris-dihydroxy-3-methylphenyl)propane;
1,1,3-tris(hydroxy-2,4-dimethylphenyl)propane;
1,1,3-tris(hydroxy-2,5-dimethylphenyl)propane;
1,1,3-tris(hydroxy-2,6-dimethylphenyl)propane;
1,1,4-tris(hydroxyphenyl)butane;
1,1,4-tris(hydroxyphenyl)-2-ethylbutane;
1,1,4-tris(dihydroxyphenyl)butane;
1,1,5-tris(hydroxyphenyl)-3-methylpentane;
1,1,8-tris(hydroxyphenyl)-octane; 1,1-10-tris(hydroxyphenyl)decane; and such corresponding compounds which contain substituent groups in the hydrocarbon chain, such as
1,1,3-tris(hydroxyphenyl)-2-chloropropane;
1,1,3-tris(hydroxy-3-propylphenyl)-2-nitropropane;
1,1,4-tris(hydroxy-3-decylphenyl)-2,3-dibromobutane; and the like.

Tetraphenylol compounds which can be used in this invention include the alpha, alpha, omega, omega, tetrakis(hydroxyphenyl)alkanes such as 1,1,2,2-tetrakis(-hydroxy-phenyl)ethane;

1,1,3,3-tetrakis(hydroxy-3-methylphenyl)propane;
1,1,3,3-tetrakis(dihydroxy-3-methylphenyl)propane;
1,1,4,4-tetrakis(hydroxyphenyl)butane;
1,1,4,4-tetrakis(hydroxyphenyl)-2-ethylbutane;
1,1,5,5-tetrakis(hydroxyphenyl)pentane;
1,1,5,5-tetrakis(hydroxyphenyl)-3-methylpentane;
1,1,5-5-tetrakis-(dihydroxyphenyl)pentane;
1,1,8,8-tetrakis(hydroxy-3-butyl-phenyl)octane;
1,1,8,8-tetrakis(dihydroxy-3-butylphenyl)octane;
1,1,8,8-tetrakis(hydroxy-2,5-dimethylphenyl)octane;
1,1,10,10-tetrakis(hydroxyphenyl)-decane, and the corresponding compounds which contain substituent groups in the hydrocarbon chain such as 1,1,6,6-tetrakis(hydroxyphenyl)-2-hydroxyhexane;
1,1,6,6-tetrakis(hydroxyphenyl)-2-hydroxy-5-methylhexane;
1,1,7,7-tetrakis(hydroxyphenyl)-3-hydroxyheptane;
1,1,3,3-tetrakis(hydroxyphenyl)-2-nitropropane;
1,1,3,3-tetrakis(hydroxyphenyl)-2-chloropropane;
1,1,4,4-tetrakis(hydroxyphenyl)-2,3-dibromobutane; and the like.

Alkanolamines may also be utilized, for example, methyldiethanolamine, diethanolamine, triethanol amine,
N,N,N',N'-tetrakis(2-hydroxy propyl) ethylene diamine,
N-propyl-N,N',N'-tri(2-hydroxyethyl)-propylene diamine,
N,N-diethanolaniline, tris-hydroxymethylaminomethane,
2-amino-2-methyl-1,3-propane diol, ethanolamine, 3-aminopropanol,
4-amino-1-propanol, 6-amino-1-hexanol, 10-amino-1-decanol,
N,N-di(hydroxyethyl)-m-toluidine, N,N-di(hydroxyethyl)-3,5-xylidine,
N,N-di(hydroxyisopropyl)-m-toluidine,
N,N-di(hydroxyisopropyl)-2,6-dimethyl aniline, and the like.

Suitable amines include arylene diamines, such as 4,4'-methylenebis(2-chloroaniline),
4,4'-methylenebis(2-bromoaniline),
4,4'-methylenebis(2-iodoaniline),
4,4'-methylenebis(2-fluoroaniline),
4,4'-methylenebis(2-methoxyaniline),
4,4'-methylenebis(2-ethoxyaniline),
4,4'-methylenebis(2-methylaniline),
4,4'-methylenebis(2-ethylaniline),
4,4'-methylenebis(2-isopropylaniline),
4,4'-methylenebis(2-n-butylaniline), and
4,4'-methylenebis(2-n-octylaniline) and the like.

Other arylene diamines which may be used include compounds such as:

bis(4-aminophenyl)sulfone,
bis(4-aminophenyl)disulfide,
toluene-2,4-diamine,
1,5-naphthalenediamine,
cumene-2,4-diamine,
4-methoxy-1,3-phenylenediamine,
1,3-phenylenediamine,
4-chloro-1,3-phenylenediamine,
4-bromo-1,3-phenylenediamine,
4-ethoxy-1,3-phenylenediamine,
2,4'-diaminodiphenylether,
5,6-dimethyl-1,3-phenylenediamine,
2,4-dimethyl-1,3-phenylenediamine, 4,4'-diaminodiphenylether, benzidine,
4,6-dimethyl-1,3-phenylenediamine,
4,4'-methylenebisaniline,
9,10-anthracenediamine,
4,4'-diaminodibenzyl,
2,4-diaminostilbene,
1,4-anthradiamine,
2,5-fluorenediamine,
1,8-naphthalenediamine,
2,6-diaminobenzfuran,
3,3'-biphenyldiamine,
2-methylbenzidine,
2,2'-dimethylbenzidine,
3,3'-dimethylbenzidine,
2,2'-dichloro-3,3'-dimethylbenzidine,
5,5-dibromo-3,3'-dimethylbenzidine,
2,2'-dichlorobenzidine,
2,2'-dimethoxybenzidine,
3,3'-dimethoxybenzidine,
2,2'5,5'-tetramethylbenzidine,
2,2'-dichloro-5,5'-diethoxybenzidine,
2,2'-difluorobenzidine,
3,3'-difluorobenzidine,
3-ethoxybenzidine,
3-ethyl-3'-methylbenzidine,
2,2',6,6'-tetrachlorobenzidine,
3,3',5,5'-tetraiodobenzidine,
3,3'5,5'-tetraiodobenzidine,
3-trifluoromethylbenzidine, 2-iodobenzidine,
1,4-phenylenediamine and the like.

Aliphatic diamines are also suitable, for example: di($\alpha$-methylbenzyl)ethylene diamine, hexamethylene diamine, 2,6-diaminopyridine, 2,4-diaminopyridine, ethylenediamine, 1,4-diaminobutane, 1,3-diaminobutane, 1,3-diaminopropane, 1,10-diaminodecane, 3,3'-diaminodipropyl ether and the like, as are amines with greater than 2 amino groups; such as 3,3'-diaminodipropylamine, triethylenetetramine, diethylenetriamine, tetraethylene pentamine, 3-(N-isopropylamino)-propylamine, 4,4'-diaminodiphenylamine, 3,3'-dimethyl-4,4'-diaminodiphenylamine, 4,4'-diamino-dibutylamine, melamine and the like.

Suitable acids include the aliphatic acids, such as malonic, succinic, glutaric, adipic, pimelic, suberic, azelaic, sebacic, $\beta$-methyladipic, 1,2-cyclohexane dicarboxylic, teraconic acid, isatropic acid, citric acid, tartaric acid and the like.

Aromatic acids are also suitable, for example isophthalic, terephthalic, uvitic (5,1,3), uvitonic (2,4,6), salicylacetic, 1,4-naphthalene dicarboxylic, 1,8-naphthalenedicarboxylic, 1,10-diphinic acid, 2,9-diphenic acid, benzophenone dicarboxylic acid, pyromellitic, mellophanic, trimellitic, trimesic and the like, as are heteroaromatic acids such as pyridine tricarboxylic acid, pyridine dicarboxylic acid and the like.

Suitable sulfnydryl compounds include 1,4-butanedithiol, 1,5-pentanedithiol, 1,2-hexanedithiol, ethylene thioglycol, propylene thioglycol, trimethylene thioglycol, 1,10-decane dithiol, 1,2-cyclohexanedithiol, 2-butene-1,4-dithiol, 2,9-para-menthanedithiol ethylcyclohexyl dimercaptan, 2,2,4-trimethyl-1,3-pentanedithiol, and the like. In this regard, the keratin fibers can be treated with reducing agents to provide reactive sulfhydryl groups in situ.

Low molecular weight, non fiber-forming polyamides such as those sold under the trademark of Versamids may also be utilized if desired.

In most instances, the isocyanate/polymeric polyhydroxy system, either as such or in pre-polymeric form, and the coreactant containing at least two active hydrogen atoms may be applied to the fabric or other structure from a single solution. In some cases, however, where the coreactant is highly reactive with the residual —N=C=X groups, such as when certain amines are utilized as the coreactant, it is preferred that the coreactant be applied to the fabric or other structure from a separate system. This may be accomplished by padding the amine, preferably drying and then applying the isocyanate/polymeric hydroxy compound system onto the fibers or vice versa.

In selecting an organic solvent to prepare solutions of the application of the various systems described above, care should be taken to provide a non-reactive solvent.

By "non-reactive" as used herein is meant a solvent in which reactivity between the isocyanate and active-hydrogen containing components, even in the presence of catalyst, is substantially inhibited. Small amounts of reactive solvents may be present provided the amount present is sufficiently low as not to precipitate a substantial amount of the components with which it is reactive. In other words, sufficient components remain reactive with the keratin fibers to provide adequate inhibition of shrinkage and/or settability in the fabric or other structure being treated.

Suitable organic solvents include halogenated hydrocarbons, such as trichloroethylene, methylene chloride, perchloroethylene, ethylene dichloride, chloroform and the like; aromatic solvents such as toluene, xylene, benzene, mixed aromatics, such as the Solvesso types and the like, n-butyl acetate, n-butyl ether, n-butyl phosphate, p-dioxane, ethyl oxalate, methyl isobutyl ketone, pyridine, quinolene, N,N-dimethylformamide, N,N-dimethylacetamide, 2,2,4-trimethylpentane and the like. Mixtures of solvents may be used.

The use of a non-reactive organic solvent enables the practitioner to combine all desired components in a single solution and reaction therebetween is substantially inhibited, thereby greatly facilitating application of all components, even catalyst, uniformly onto the desired structure in controllable amounts. In the absence of a non-reactive solvent, the combined components and catalysts would react, often quite readily, to produce an insoluble polyurethane type polymer which cannot be conveniently applied to the fabric or other structure uniformly in the amounts desired. This reaction, however, is inhibited when a non-reactive solvent is used and the inhibiting influence substantially continues in the fabric until the solvent is removed by any conventional drying technique. After the solvent is removed, the various components are free to cure on the keratin fibers.

By "cure" as used herein is meant the reaction of the various components, such as the isocyanate/polymeric polyhydroxy compound system, or prepolymers therefrom, blocked or unblocked and with or without a coreactant, with the keratin fibers. It is believed that the components react with the fibers, in that extraction methods fail to remove the components after curing. The mechanism of the reaction with the keratin fibers, however, is not completely understood.

When a pre-polymer is applied, it is probable that the terminal —N=C=X groups thereof react with the various groups in the wool molecule which contain active hydrogen atoms, for example, in amino, hydroxy, thiols, amide, guanidine, carboxyl and imido groups.

When the isocyanate, polymeric polyhydroxy compound and catalyst are mixed without apparent reaction therebetween and applied directly to the keratin fibers, it is not at all understood just how the various components combine with the keratin fibers to inhibit the shrinkage thereof or set the fibers in a given configuration. It is not known, for example, whether the components first combine to form an —N=C=X terminated pre-polymer which then reacts with the keratin fiber or whether the components react individually or sequentially with the keratin fibers.

It is believed, however, that the isocyanate-terminated compounds utilized in the process of this invention, either in pre-polymeric form or as available polyfunctional isocyanates per se, as in a mixture thereof with polymeric polyols in a nonreactive solvent, react with active hydrogen atoms in the wool molecule as follows:

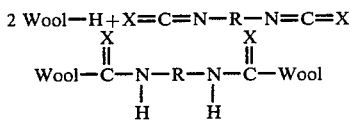

wherein X is as before and R is the residue from the above isocyanate-terminated compounds.

While the coreactant utilized in accordance with a preferred embodiment of this invention very likely induces some cross-linking in the reaction product of the above systems and the keratin fibers, the mechanism of the cross-linking is similarly not understood.

The presence of regain amounts of water in the structure of keratin fibers will consume free isocyanate groups and thereby lower the —N=C=X to active hydrogen atom ratio of the total system, with a consequent increase in felting shrinkage or decrease in settability where the initial ratio is low. This problem may be readily solved by either drying and maintaining dry the said structure during treatment or by compensating for this regain moisture by addition of equivalent amounts of isocyanate groups to react with this water.

Even though the mechanism of curing is not completely known, it is most apparent in the practice of this invention that a very high level of shrinkage inhibition and/or setting is produced with only very small amounts of isocyanates, when there is combined therewith a polymeric polyhydroxy compound, either as such or when a prepolymer is formed therefrom, and with or without a coreactant present and whether the isocyanate or prepolymer thereof is blocked or unblocked as set forth below. Furthermore, the handle of fabrics so treated is superior to fabrics similarly treated but in the absence of these additional components.

Exposure of the impregnated fabric or other structure to temperatures above ordinary room temperatures increases the rate of curing. Temperatures exceeding about 220° to about 260° F. are preferred, while temperatures above about 300° F. are considered higher than necessary. Such higher temperatures, however, may be utilized provided care is taken not to expose the keratin fiber to these higher temperatures for so long a time that undue degradation takes place.

The time of curing varies inversely with the temperature utilized. Optimum balance of time and temperature may readily be determined by the practitioner of this invention through shrinkage tests or crease ratings.

Improved shrinkage control is obtained in many instances if any aging period is interposed between the curing and scouring operations. Aging is similarly preferred in the durable setting of keratin fibers, although the scouring operation, for a garment manufacturer, is generally not feasible or necessary in this particular embodiment of the invention. This aging, believed to be an extenuation of the curing mechanism, may be conducted for any desired period of time, based upon the degree of shrinkage inhibition and/or settability desired. Aging periods of from about 12 to about 24 hours, or more or less are quite satisfactory.

In the shrinkage inhibition embodiment of this invention, it has been found that the properties of fabrics and other structures treated in accordance with this invention are improved by mechanically working the fibers of the fabric after curing. This is most efficaciously accomplished during the scouring operation, during which the fabric is passed repeatedly in and out of an aqueous solution containing small amounts of a wetting agent, with periodic squeezing between rolls. Similar effects are noted during normal dyeing after treatment. This subsequent immersion in aqueous media may cause hydrolysis of the reaction product of the keratin fibers with the isocyanate/polymeric polyhydroxy compound system, or prepolymers therefrom, but whatever the reason, sufficient improvement is noted that a scouring or equivalent operation or other mechanical working of the fabric after curing is a highly preferred technique.

While any amount of the various systems of this invention may be applied to structures containing keratin fibers to modify the characteristics thereof, excellent relaxation and felting shrinkage inhibition and/or settability has been obtained at levels as low as about 2% total pickup of all components added. If it is desired to obtain relaxation shrinkage inhibition only or a lesser degree of settability, then lesser amounts may be used. Generally, no more than about 6% by weight of the components is required in any instance. Great amounts, e.g., up to about 10% or more may be utilized, if desired, for specific end uses where soft handle is not required.

The desired amount of the components may be applied by any of the conventional techniques for applying liquids to fabrics, for example, by padding, immersing, spraying, from applicator rolls or other techniques whereby all fibers are treated substantially uniformly.

It has been found that better results are obtained if the pH of the fabric or treating solution is maintained substantially neutral. Strongly basic solutions, for example, those above a pH of about nine, may cause excessive damage to keratin fibers if the pH thereof is raised to this level for too long a period of time, while some difficulty may be experienced in obtaining good results when the fabric or treating solution is maintained below a pH of about three. The fabric or other structure, which is often quite acidic, because of the carbonizing procedure which entails treatment with strong acid, is preferably washed or neutralized prior to treatment in accordance with this invention, to raise the pH level thereof.

The process of this invention may be utilized to improve the properties of any structure containing keratin fibers, either woven, non-woven, or knitted, dyed or undyed. Dyeing may be conducted after these structures have been treated in accordance with this invention without deleterious effects on the dyestuffs.

For that matter, it has been found that pre-treatment of keratin fibers with the systems of this invention greatly enhances the dyeability of keratin fibers with conventional dyestuffs. The keratin fibers accept the dyestuffs more readily and to a greater degree after reaction with the systems of the invention, so that less dyestuff is required for a given shade of dyeing. For example, after treatment of keratin fibers in accordance with this invention, up to about 20% less dyestuff is required to obtain the same shade when dyeing these keratin fibers with pre-metallized and acid milling dyestuffs used conventionally to dye keratin fibers, particularly wool.

The structure may be composed entirely of wool fibers or be produced from blends thereof with synthetic, natural or other keratin fibers. Preferred synthetic fibers include polyamides, such as poly (hexamethylene adipamide) and those derived from caprolactam; polyesters, such as poly(ethylene terephthalate); and acrylic fibers, such as acrylonitrile homopolymers or copolymers containing at least about 85% combined acrylonitrile, e.g., acrylonitrile/methylacrylate (85/15) and cellulosics, such as cellulose acetate and viscose rayon. Of the natural fibers which may be blended with the keratin fibers, cotton is preferred. Other keratin fibers include mohair, alpaca, cashmere, vicuna, guanaco, camel hair, silk, llama, and the like.

Among the suitable isocyanates that may be used in accordance with this invention there are included aryldiisocyanates, such as 2,4-toluene diisocyanate, 2,6-toluene diisocyanate, 4,4'-diphenylmethane diisocyanate, p-phenylene diisocyanate, 1,5-naphthylene diisocyanate, m-phenylene diisocyanate, diphenyl-4,4'-diisocyanate, azobenzene-4,4'-diisocyanate, diphenylsulphone-4,4'-diisocyanate, 1-isopropylbenzene-3,5-diisocyanate, 1-methyl-phenylene-2,4-diisocyanate, naphthylene-1,4-diisocyanate, diphenyl-4,4'-diisothiocyanate and diisocyanate, benzene-1,2,4-triisothiocyanate, 5-nitro-1,3-phenylene diisocyanate, xylylene-1,4-diisocyanate, xylylene-1,3-diisocyanate, 4,4'-diphenylenemethane diisocyanate, 4,4'-diphenylenepropane diisocyanate and xylylene-1,4-diisothiocyanate and the like; alicyclic diisocyanates, such as dicyclohexamethane-4,4'-diisocyanate and the like; alkylene diisocyanates such as tetramethylene diisocyanate, hexamethylene diisocyanate and the like, as well as mixtures thereof and including the equivalent isothiocyanates. Of these compounds, the aryldiisocyanates are preferred because of their solubility and availability.

Additional isocyanates include polymethylene diisocyanates and diisothiocyanates, such as ethylene diisocyante, dimethylene diisocyanate, dodecamethylene diisocyanate, hexamethylene diisocyanate, tetramethylene diisocyanate, pentamethylene diisocyanate, and the corresponding diisothiocyanates; alkylene diisocyanates and diisothiocyanates such as propylene-1,2-diisocyanate, 2,3-dimethyltetramethylene diisocyanate and diisothiocyanate, butylene-1,2-diisocyanate, butylene-1,3-diisothiocyanate, and butylene-1,3-diisocyanate; alkylidene diisocyanates and diisothiocyanates such as ethylidene diisocyanate ($CH_3CH(NCO)_2$) and heptylidene diisothiocyanate ($CH_3(CH_2)_5CH(CNS)_2$); cycloalkylene diisocyanates and diisothiocyanates such as 1,4-diisocyanatocyclohexane, cyclopentylene-1,3-diisocyanate, and cyclohexylene-1,2-diisothiocyanate; aromatic polyisocyanates and polyisothiocyanates such as aliphatic-aromatic diisocyanates and diisothiocyanates such as phenylethylene diisocyanate ($C_5H_6CH(NCO)CH_2NCO$); diisocyanates and diisothiocyanates containing heteroatoms such as $SCNCH_2OCH_2NSC$, $SCNCH_2CH_2OCH_2CH_2NSC$ and $SCN(CH_2)_3—S—(CH_2)_3NSC$; 1,2,3,4-tetraisocyanatobutane, butane-1,2,2-triisocyanate, toluylene-2,4,6-triisocyanate, toluylene-2,3,4-triisocyanate, benzene-1,3,5-triisocyanate, benzene-1,2,3-triisocyanate, 1-isocyanato-4-isothiocyanatohexane, and 2-chloro-1,3-diisocyanatopropane.

The preferred diisocyanates, diisothiocyanates and mixed isocyanate-isothiocyanates have the general formula ZCN—R—NCZ in which R is a divalent hydrocarbon radical, preferably aryl, and Z is a chalcogen of atomic weight less than 33. For availability, toluylene 2,4-diisocyanate is preferred.

These isocyanates or isocyanate-terminated prepolymers produced therefrom may be derived from the corresponding blocked compound in accordance with conventional technology. Blocked isocyanates and blocked isocyanate-terminated prepolymers contain little or no free isocyanate groups, as the result of the addition onto these groups by active hydrogen compounds (as determined by the Zerewitinoff method). These addition products are relatively inert at room temperatures but have only limited thermal stability so that, upon heating beyond a certain temperature, called the unblocking temperature, the addition product is activated, or freed, to form the same type product with keratin fibers as would the unblocked compound.

Preferred adduct-forming compounds produce adducts which may be activated, or unblocked, by heat alone. Typical active hydrogen compounds which provide heat-reversible adducts include the following:

1. Tertiary alcohols, such as tertiary butyl alcohol, tertiary amyl alcohol, dimethyl ethinyl carbinol, dimethyl phenyl carbinol, methyl diphenyl carbinol, triphenyl carbinol, 1-nitro tertiary butyl carbinol, 1-chloro tertiary butyl carbinol, and triphenyl silinol and the like;

2. Secondary aromatic amines which contain only one group having a hydrogen reactive with an isocyanate group, such as the diaryl compounds, including diphenyl amine, o-ditolyl amine, m ditolyl amine, p-ditolylamine, N-phenyl toluidine, N-phenyl xylidine, phenyl alpha naphthyl amine, phenyl beta naphthyl amine, carbazole, and the nuclear substituted aromatic compounds such as 2,2'-dinitro diphenyl amine and 2,2' dichloro diphenyl amine and the like;

3. Mercaptans, such as 2-mercaptobenzothiazole, 2-mercapto thiazoline, dodecyl mercaptan, ethyl 2-mercapto thiazole, dimethyl 2-mercapto thiazole, beta naphthyl mercaptan, alpha naphthyl mercaptan, phenyl 2-mercapto thiazole, 2-mercapto 5-chlorobenzothiazole, methyl mercaptan, ethyl mercaptan, propyl mercaptan, butyl mercaptan, and ethinyl dimethyl thiocarbinol and the like;

4. Lactams, such as epsilon-caprolactam, delta-valerolactam, gamma-butyrolactam, and beta-propiolactam;

5. Imides, such as carbimide, succinimide, phthalimide, naphthalimide, and glutarimide;

6. Monohydric phenols in which the hydroxyl group is the only group containing hydrogen reactive with the isocyanate group, such as the phenols, cresols, xylenols, trimethyl phenols, ethyl phenols, propyl phenols, chloro phenols, nitro phenols, thymols, carvacrols, mono alpha phenyl ethyl phenol, di alpha phenyl ethyl phenol, tri alpha phenyl ethyl phenol, and tertiary butyl phenol and the like;

7. Compounds containing enolizable hydrogen, such as acetoacetic esters, diethyl malonate, ethyl n-butyl malonate, ethyl benzyl malonate, acetyl acetone, acetonyl acetone, benzimidazole, and 1-phenyl-3 methyl 5-pyrazolon and the like.

The adduct-forming compounds, should, of course, possess only one group containing a reactive hydrogen atom. The presence of more than one such group would permit polymerization reactions wth the polyisocyanate, which are not desired in most instances.

Among the more preferable adduct-forming compounds are included diphenyl amine, phenyl beta naphtylamine, succinimide, phthalimide, teriary butyl alcohol, tertiary amyl alcohol, dimethyl ethinyl carbinol, acetoacetic ester, diethyl malonate, mono alpha phenyl ethyl phenol, epsilon-caprolactam, and 2-mercaptobenzothiazole and others shown in the Examples.

It is believed that the adducts formed by reacting a polyisocyanate or prepolymer therefrom with a compound from the groups listed above will become activated and dissociate into the original components upon application of heat to the system, so that such adducts may be mixed with reactants having a plurality of groups containing reactive hydrogen with the result that there is a reduction in the rate of reaction forming the polymeric materials until the mixture is subjected to heat.

In the preparation of the mono-adducts in general the polyisocyanate and the adduct-forming compound are usually dissolved in a suitable inert solvent such as toluene, methyl ethyl ketone, or o-dichlorobenzene. The solutions are stirred together and permitted to stand. The reaction should be caused to take place at a temperature below the decomposition temperature of the desired product and preferably at a temperature not exceeding approximately 100° C. In most instances, the reaction will proceed satisfactorily at room temperature. When the solvent used for the isocyanate compound and blocking agent is not also a solvent for the adduct formed, the adduct formed separates from the solution and is removed therefrom by filtration or evaporation of the solvent. The time required for the adduct to form will vary from a few minutes to several hours depending upon the particular reactants used. If a mono-adduct of a polyisocyanate is desired, usually an excess of the polyisocyanate is provided so that the product which separates will be substantially pure mono-adduct. The precipitated product will probably contain small amounts of unreacted material which, if necessary, can be removed by recrystallization or extraction procedures known to those skilled in the art.

In one embodiment of this invention, a blocked isocyanate is applied to keratin fibers in combination with a polymeric polyhydroxy compound. Upon heating beyond the unblocking temperature, e.g., during curing, the blocked isocyanate is believed to dissociate into the isocyanate and blocking agent, the isocyanate then being free to react with the polymeric hydroxy compound and keratin fibers in the presence of the blocking agent. The mechanism of this particular reaction is no more fully understood than the reaction using unblocked isocyanates, but the result is essentially the same whether the isocyanate is blocked or unblocked, indicating that the reaction mechanisms for the respective reactions, whatever they are, are essentially similar.

When a blocked prepolymer is utilized, the same situation occurs, viz., upon heating beyond the unblocking temperature the blocked prepolymer is activated and freed to react with the keratin fibers to form the same reaction product with keratin fibers as if the prepolymer had not been blocked.

When a blocked compound is utilized, the ratio of —N=C=X groups to active hydrogen atoms may be computed from the number of such groups which are theoretically available after unblocking.

Catalysts and/or coreactants can be utilized in these embodiments of the invention just as if the isocyanate compound were not blocked.

Since these blocked isocyanate compounds are not free to react with other reactants or the keratin fibers except upon thermal activation, they are quite stable, so that the use of a non-reactive organic solvent is not necessary. Consequently, the blocked isocyanate compounds may be applied to keratin fibers from aqueous systems, e.g., in the form of an aqueous emulsion or dispersion. For better penetration and uniformity of application of the blocked isocyanate compound into the keratin fibers, however, it is still preferred to apply these compounds from an organic solution.

The blocked isocyanate compounds are stable during storage and would be preferred in some instances where stability is a problem. It should be noted, however, that the use of non-reactive solvents substantially eliminates stability problems with the unblocked isocyanate compounds utilized herein, so that these systems are generally preferred for the improved results obtained in their use.

By "polymeric polyhydroxy compound" is meant a linear long-chain polymer having terminal hydroxyl groups including branched, polyfunctional polymeric hydroxy compounds as set forth below. Among the suitable polymeric polyhydroxy compounds, there are included polyether polyols such as polyalkyleneether glycols, and polyalkylenearyleneether-thioether glycols and polyalkyleneether triols. Polyalkyleneether glycols and triols are preferred. Mixtures of these polyols may be used when desired.

The polyalkyleneether glycols may be represented by the formula $HO(RO)_nH$, wherein R is an alkylene radical which need not necessarily be the same in each instance and $n$ is an integer. Representative glycols include polyethyleneether glycol, polypropyleneether glycol, polytrimethyleneether glycol, polytetramethyleneether glycol, polypentamethyleneether glycol, polydecamethyleneether glycol, polytetramethyleneformal glycol and poly-1,2-dimethylethyleneether glycol. Mixtures of two or more polyalkyleneether glycols may be employed if desired.

Representative polyalkyleneether triols are made by reacting one or more alkylene oxides with one or more low molecular weight aliphatic triols. The alkylene oxides most commonly used have molecular weights between about 44 and 250. Examples include: ethylene oxide; propylene oxide; butylene oxide; 1,2-epoxybutane; 1,2-epoxyhexane; 1,2-epoxyoctane; 1,2-epoxyhexadecane; 2,3-epoxybutane; 3,4-epoxyhexane; 1,2-epoxy-5-hexene; and 1,2-epoxy-3-butane, and the like. Ethylene, propylene, and butylene oxides are preferred. In addition to mixtures of these oxides, minor proportions of alkylene oxides having cycle substituents may be present, such as styrene oxide, cyclohexene oxide, 1,2-epoxy-2-cyclohexylpropane, and a-methyl styrene oxide. The aliphatic triols most commonly used have molecular weights between about 92 and 250. 1 Examples include glycerol, 1,2,6-hexanetriol; 1,1,1-trimethylolpropane; 1,1,1-trimethylolethane, 2,4-dimethylol-2-methylol-pentanediol-1,5 and the trimethylether of sorbitol.

Representative examples of the polyalkyleneether triols include: polypropyleneether triol (M. W. 700) made by reacting 608 parts of 1,2-propyleneoxide with 92 parts of glycerine; polypropyleneether triol (M. W. 1535) made by reacting 1401 parts of 1,2-propyleneoxide with 134 parts of trimethylolpropane; polypropyleneether triol (M. W. 2500) made by reacting 2366 parts of 1,2-propyleneoxide with 134 parts of 1,2,6-hexanetriol; and polypropyleneether triol (M. W. 6000) made by reacting 5866 parts of 1,2-propyleneoxide with 134 parts of 1,2,6-hexanetriol.

Additional suitable polytriols include polyoxypropylene triols, polyoxybutylene triols, Union Carbides' Niax triols LG56, LG42, LG112 and the like; Jefferson Chemical's Triol G-4000 and the like; Actol 32-160 from National Aniline and the like.

The polyalkylene-aryleneether glycols are similar to the polyalkyleneether glycols except that some arylene radicals are present. Representative arylene radicals include phenylene, naphthalene and anthracene radicals which may be substituted with various substituents, such as alkyl groups. In general, in these glycols there should be at least one alkyleneether radical having a molecular weight of about 500 for each arylene radical which is present.

The polyalkyleneether-thioether glycols and the polyalkylenearyleneether glycols are similar to the above-described polyether glycols, except that some of the ether-oxygen atoms are replaced by sulfur atoms. These glycols may be conveniently prepared by condensing together various glycols, such as thiodiglycol, in the presence of a catalyst, such as p-toluene-sulfonic acid.

Stabilization of a fabric depends to a great extent on its density, e.g., at lower densities, higher levels of treatment are usually utilized for best results.

The processes of this invention may be varied to provide various levels of control of both relaxation and felting shrinkage. For example, in some fabrics it may be desired to reduce relaxation shrinkage only, in that washability by reduction of felting shrinkage may not be required. For washable fabrics, both relaxation and felting shrinkage should be reduced to an acceptable level. Techniques for providing both type effects are illustrated in the following Examples.

It has also been discovered that the technology of the present invention may be utilized to impart durable configurations to keratin fibers, particularly to fabrics containing a major proportion of keratin fibers.

Such a process is provided by curing keratin fibers treated with the various systems of this invention while holding the fibers in the desired configuration. The keratin fibers, particularly fabrics containing them, are most conveniently held in the desired configuration during at least the initial stages of curing by pressing elements, preferably heated to initiate and facilitate curing. For example, there may be utilized such pressing elements as hand irons, pleating papers, rotary presses, decating machines, paper-presses, calendar rolls, Hoffman presses, and the like.

It is also possible, in accordance with this invention, to set crimp in keratin fibers, either in fabric form or pre-fabric form, e.g., roving, silver, yarn and the like.

In pre-fabric form, the fibers can be set by curing while maintaining the fibers in a crimped or otherwise distorted configuration. The distorted configuration is most readily achieved in this embodiment of the invention by mechanical means, such as gear-crimping apparatus, stuffer boxes and the like.

One of the systems of this invention can be applied to the fibers prior to distortion thereof, or afterwards, as desired, although it is generally preferred for control purposes to impregnate the fibers with one of the systems of this invention prior to distortion.

Permanently crimped yarn can also be obtained by knitting the yarn into fabric form and setting the fabric by impregnating the fabric with one of the systems of this invention and curing. The cured, and thereby set, knitted fabric is then unravelled. The resulting yarn is permanently set in the configuration in which it was set while in knitted form.

The setting of crimp in keratin fibers in fabric form has its greatest applicability in the field of stretch fabrics. In the production of all-wool stretch fabrics, or fabrics containing at least a major proportion of wool fibers, a base fabric is shrunk by immersion in a treating solution, with or without reducing agents, so as to increase the crimp amplitude in either or both warp and filling yarns thereof. This increased crimp amplitude is substantially recoverable as stretch in the fabric. When such a fabric is treated with one of the systems of this invention and cured while in its shrunken condition, the rate of the fabric's return from a stretched condition, i.e., the fabric's elastic recovery rate, is greatly increased, thereby providing a livelier stretch fabric.

Once again, one of the systems of this invention may be applied to the fabric before or after shrinking, but, in this embodiment, it is generally preferred to impregnate the fabric with one of the systems of this invention after shrinking in order to avoid any effects that the shrinking bath may have on the compound systems of this invention. The impregnated fabric is then dried and cured to set the fabric in its shrunken condition.

Crimp in the yarns of a fabric may also be induced by mechanical means, such as compacting, wherein a fabric is mechanically shrunken in a given direction, e.g., the warp direction. One apparatus for accomplishing this effect is the Compactor, trade name for equipment developed by Fabric Research Laboratories. In this embodiment of the invention, the fabric is preferably impregnated with one of the compound systems, dried, compacted, and cured to permanently set the fabric in its compacted form to obtain stretch in the direction of compacting. This technique is particularly useful for obtaining fabrics having stretch in the wrap direction.

Fabrics having enhanced stretch in the filing direction only can be obtained by impregnating the fabric with one of the systems of this invention and exerting tension forces thereon in the warp direction during either or both drying and heating wherein curing is initiated. By this procedure, the crimp amplitude in the filing yarns is increased. The fabric is maintained in this condition throughout drying and curing, which as noted above, generally extends through an aging period, to provide a fabric having enhanced stretch properties in the filling direction.

Fabrics treated with the various systems of this invention can have durable configurations imparted thereto in the textile mill, e.g., by pressing to impart a durable, lustrous finish, or presensitized in the mill for subsequent durable setting by the garment manufacturer.

Durable luster or other effects wherein surface fibers of the fabric are set in a given configuration can be imparted to fabrics in the mill by impregnating the fabric with the systems of this invention and then at least partially curing the impregnated fabric while pressing at least one surface, e.g., by passing the impregnated fabric between heated rolls at a temperature sufficient to initiate the cure. For embossed effects, batch or continuous molding procedures involving longer curing times under pressure are preferred.

Alternatively, the impregnated fabric can be pressed into the desired configuration and, in a separate operation, cured while substantially maintaining the configuration, whereupon this configuration will be retained even during subsequent wetting. In other words, it is essential only that the fabric be maintained in the desired configuration during curing. The configuration is most conveniently imparted during the early stages of curing, but the curing step can follow the pressing step if desired. In many instances, in fact, curing continues during an ageing period following the normal curing operations. In that event, improved results are obtained if care is taken to maintain the fabric in its desired configuration during ageing also. For that matter, some permanent setting of the fabric can be achieved during the ageing period, if desired.

Calendering techniques are preferred for imparting finishes in the mill. Calendering pressures from about ½ ton to about 2 tons per linear inch, preferably about 1 ton to about 1½ tons per linear inch, are preferred. The upper limit for calendering pressures may be higher; the only real limitation being the equipment utilized and the properties desired.

Fabrics may be presensitized in the mill for subsequent durable setting by garment manufacturers by impregnating the fabric with one of the systems of this invention and maintaining the dried impregnated fabric in a substantially uncured state until after garments have been produced from the fabric. The fabric can then be pressed into the desired configuration and cured, whereupon the configuration is durably set into the fabric.

As when lustrous finishes or other configurations are imparted at the mill level, the pressing and curing operations, though preferably simultaneous, may be performed in sequence, provided the fabric is maintained in the desired configuration, e.g., in a creased state, during curing. For example, an impermanent crease can be imparted to the fabric on the conventional Hoffman press utilized by the majority of garment manufacturers, particularly trouser manufacturers, and the creased fabric aged in this configuration to permanently set the crease.

In the presensitizing field, it is preferred to use either a blocked polyfunctional isocyanate or a blocked prepolymer, since the blocked polyfunctional isocyanate or a blocked prepolymer, since the blocked compounds have greater ability during shipment and storage than the equivalent unblocked compound. Storage periods for presensitized fabrics vary considerably, so that the blocked compounds provide a margin of safety without affecting performance.

In this embodiment of the invention, the blocked compound on the fabric is activated for reaction with the keratin fibers and other active hydrogen compounds available on the fabric by means of a heat-setting operation, e.g., by Hoffman pressing, steaming in an autoclave and the like, during which curing is at least initiated. Curing can then be completed during an aging period. For best results, as mentioned above, the fabric is maintained in the desired configuration during aging, or at least until curing has been substantially completed.

A further advantage of this embodiment is that the blocked systems of this invention can be applied to the fabric from a waterbased system, such as a dispersion or emulsion. Emulsions of these systems are normally produced from organic solutions of the blocked isocyanate compound by the addition of water and wellknown emulsifying agents thereto. This procedure, obviously, is less costly than when organic solutions per se are utilized, although improved penetration and hand is obtained when the blocked compound is applied to the keratin fibers from an organic solution.

As in the other embodiments of this invention, improved results are generally obtained when a catalyst and/or coreactant are present during curing. The same amounts of reactants are utilized for durable setting in a given configuration as are utilized for stabilization of fabrics.

Durable configurations are imparted, in accordance with this invention, to fabrics containing keratin fibers while obtaining many desirable properties in the fabric. For example, the fabric is substantially stabilized toward both relaxation and felting shrinkage and, furthermore, has enhanced physical properties, such as tensile strength and abrasion resistance, rather than diminished physical properties as results from the prior art processes which utilize reducing agents. In addition, fabrics so treated have no unpleasant odor such as characterizes the products of these other processes. Furthermore, these durable configurations are obtained in the absence of the large quantities of water required by many prior art processes.

Parts are given on a dry basis in the Examples, as % pickup on the wool sample being treated, unless otherwise indicated.

In many of the following Examples, particularly where the level of shrinkage is above about 5%, the shrinkage values obtained may be lowered even further merely by increasing the level of pickup of the components. In the Examples, the effect of varying certain of the components is shown by lowering the level of pickup, so that differences in effect will be more apparent.

EXAMPLE I

Formation of a Pre-polymer

Into a jacketed stainless steel reactor is poured 225 lbs of polypropylene glycol having a molecular weight of about 2,000. The reactor is then closed and the pressure therein reduced to about 10mm mercury after which the reactor is flushed with dry nitrogen. The pressure regulation and flushing operation is repeated for 3 cycles, after which 23 lbs. of dry toluene is poured into the reactor. A blanket of nitrogen gas is maintained in the vessel throughout the reaction. The pressure is again reduced to 10mm mercury and the reactor is heated to 140° C. to distill off the toluene, after which it is cooled to room temperature using cold water in the jacket around the reactor. The pressure is returned to room conditions and 20.5 grams of Union Carbide's L45 silicone resin and 408.6 grams of distilled water is poured into the reactor. After stirring for 15 minutes to thoroughly mix the components, 32.175 lbs. of toluylene-2,4-diisocyanate is added rapidly and stirred until the heat of reaction ceases and the temperature has risen slowly up to 40°–45° C. from room to temperature of about 28° C. This occurs in about 20 minutes. The reaction mix is then heated at a rate of about 2° C. per minute to a temperature of 146° C. where it is held for 18 minutes and then cooled at a rate of about 2° C. per minute to a maximum temperature of 100° F. Additional toluylene-2,4-diisocyanate (60.75 lbs.) is then added to the reactor and stirred for 30 minutes, after which 135.2 lbs. of trichloroethylene is added, thereby providing a solution containing 70% of the resulting pre-polymer. The pre-polymer solution is then transferred from the reactor to a pre-dried drum under a dry nitrogen atmosphere to avoid water contamination. At the time of the transfer, the pre-polymer solution has a color of from colorless to a very pale straw color. The viscosity of the prepolymer at this time is about 900 cps. (Brookfield viscosimeter spindle #2).

The treating solutions are prepared from the 70% solution of the pre-polymer by dilution with additional trichloroethylene to below 20% solids to inhibit destabilization upon addition of coreactive ingredients after which are added varying amounts of coreactive ingredients after which are added varying amounts of Dow Corning's 1172 silicone resin and the coreactant Quadrol, (tradename for N, N, N', N'-tetrakis (2-hydroxy propyl) ethylene diamine). The resulting solutions are then diluted further with trichloroethylene, depending upon the wet pickup that will be obtained on application of the various solutions to the fabric to obtain the desired amount of dry pickup of the various components on the fabric. This compounding technique is conducted throughout the Examples.

The various solutions are then padded onto swatches of various fabrics (described below) to various levels of pickup as shown in Table I. The fabric swatches are then placed in an oven at 160° F. for 5 min. for drying and then placed in a second oven at 250° F. for 5 minutes for curing.

Unless otherwise indicated, all shrinkage tests are run on unscoured samples. Where the samples are scoured prior to testing, the procedure is as follows for succeeding Examples.

The fabric is scoured in a dolly washer for 40 passes using water (100°–110° F.) and 0.25% on the weight of wool of a wetting agent (surfonic N95), followed by 20 passes in plain water to rinse and 20 more passes in a solution of Ampitol QIL softener after which the fabric is dried on a tenterframe to return the fabric to its initial dimensions (before scouring dimensions) and the shrinkage tests are run on the so treated fabrics.

After aging for 33 hours, the swatches are immersed in water containing a small amount of Sulfonic N-95, a nonionic wetting agent, at 140° F. for 30 minutes, after which they are dried in a relaxed state on racks, pressed and measured to determine the extent of relaxation shrinkage. The swatches (3 lb. load) are then washed in a Kenmore washer at 140° F. for 12 minutes, rinsed at 105° C. and spun-dried for a total cycle of 20 minutes. The above wash cycle is repeated 9 times after which the felting shrinkages are measured. The relaxation and felting shrinkage values are given in Table I.

In Table I. Fabric X is a plain weave, all wool, piece-dyed fabric having 35 ends and 24 picks per inch of 3.875 run yarn.

Fabric Y is a plain weave, fancy, fabric of 37 ends and b 30 picks per inch of 5.5 run, package-dyed yarn of a blend composed of 85 parts wool and 15 parts nylon.

Fabric Z is a plain weave, fancy fabric of 25 ends and 22 picks per inch of 5.5 run, package-dyed yarn composed of a blend of 80 parts wool and 20 parts nylon.

All these fabrics are produced on the woolen system.

Relaxation shrinkage and felting shrinkage tests are determined as described above on all samples tested.

TABLE 1

| | Pickup (%) Dry Basis | | | Area Shrinkage (%) | |
|---|---|---|---|---|---|
| Fabric | Pre-polymer | Silicone | Quadrol | Relaxation | Felting |
| Control X | — | — | — | 16.1 | 46.3 |
| " | 3.15 | 0.34 | 0.23 | 0.9 | 2.7 |
| " | 3.49 | 0.38 | 0.26 | 0.9 | 3.0 |
| " | 3.49 | 0.94 | 0.26 | 0.6 | 4.1 |
| " | 3.84 | 0.41 | 0.28 | 0.8 | 3.4 |
| Y | 3.15 | 0.34 | 0.23 | 1.2 | 2.3 |
| " | 3.49 | 0.38 | 0.26 | 0.4 | 1.8 |
| " | 3.49 | 0.94 | 0.26 | 0.7 | 2.1 |
| " | 3.84 | 0.41 | 0.28 | 0.6 | 1.6 |
| Z | 3.15 | 0.34 | 0.23 | 0.1 | 2.4 |
| " | 3.49 | 0.38 | 0.26 | 0.9 | 1.0 |
| " | 3.49 | 0.94 | 0.26 | 0.4 | 2.0 |
| " | 3.84 | 0.41 | 0.28 | 0.9 | 1.9 |

EXAMPLE II

A solution in trichloroethylene of the pre-polymer of Example I is padded onto a swatch of the all-wool fabric of Example I to 3.0% pickup of the pre-polymer. The thoroughly impregnated fabric is then removed, dried at 140° F. and aged for 48 hours at room conditions without heat-treatment. The swatch is then tested for relaxation and felting shrinkage as in Example I, the values being 0.9% and 2.7% respectively.

EXAMPLE III

Swatches of the all-wool fabric of Example I are thoroughly impregnated with trichloroethylene solutions containing the amounts of the pre-polymer of Example I and Quadrol shown in Table II. The percent pickup (on a dry basis) of the various components is also shown. These swatches are then dried, cured and tested as in Example I.

TABLE II

| Pickup (%) | | Area Shrinkage (%) | |
|---|---|---|---|
| Pre-polymer | Quadrol | Relaxation | Felting |
| — | — | 16.1 | 46.3 (control) |
| 2.0 | 0.35 | 5.9 | 5.9 |
| 2.0 | 0.25 | 4.7 | 5.5 |
| 2.0 | 0.10 | 5.1 | 3.7 |
| 2.0 | 0.06 | 5.8 | 2.8 |
| 2.0 | 0.03 | 5.9 | 3.6 |
| 2.0 | 0.01 | 9.0 | 2.5 |

The pickup for these embodiments may be increased if lower area shrinkage values are desired.

EXAMPLE IV

A swatch of the all-wool fabric of Example I is impregnated with a trichloroethylene solution, diluted as in Example I, containing 100 parts of the pre-polymer of Example I, 2.0 parts of N-methyl morpholine and 7.3 parts of Quadrol.

In this embodiment the pre-polymer is picked up in an amount of 2%, the N-methyl morpholine catalyst in an amount of 0.04% and the Quadrol in an amount of 0.15%. After drying, curing and testing as in Example I, the relaxation and felting shrinkages, respectively, for this fabric are found to be 6.6% and 4.7%, compared to the untreated control which has values of 16.1 and 46.3%, respectively.

EXAMPLE V

The procedure of Example IV is repeated, except that 10.0 parts of N-methyl morpholine catalyst, but no Quadrol, are added to the pre-polymer solution. The pickup on the fabric is 3.5% of the pre-polymer and 0.3% of the catalyst to provide a fabric having a relaxation shrinkage and a felting shrinkage, respectively, of 10.0 and 1.1%, compared to the values for the untreated control of 16.1 and 46.3%, respectively.

EXAMPLE VI

The procedure of Example IV is repeated except that the fabrics are cured for only 15 minutes and the pickup of pre-polymer, catalyst and Quadrol, respectively, are 3.5, 0.35 and 0.26%. The resulting fabric has a relaxation shrinkage and a felting shrinkage, respectively, of 3.6 and 3.7%.

This procedure is repeated using decreasing amounts of N-methyl morpholine catalyst, that is, 5.0%, 2.0% and no catalyst. The pickup of catalyst on these fabrics, respectively, is 0.17, 0.07 and 0%, to provide relaxation and felting shrinkages, respectively, of 2.9 and 4.8, 2.9 and 3.6, 3.7 and 4.0% compared to the control values of 16.1 and 46.3%, respectively.

EXAMPLE VII

The first test of Example VI is repeated, except that the fabric is not aged for a period of 48 hours after treatment, but rather is immediately tested for relaxation and felting shrinkages, which are 7.6 and 2.6%, respectively.

This procedure, wherein aging is eliminated, is repeated for the embodiment of Example VI wherein no catalyst is used. The fabrics so treated have relaxation and felting shrinkage values, respectively, of 6.5 and 3.6%.

EXAMPLE VIII

To a pre-polymer solution in trichloroethylene diluted as in Example I and containing 100 parts of the pre-polymer of Example I and 2.0 parts of N-methyl morpholine catalyst, are added various coreactants as set forth in Table III in the amounts given. Swatches from the all-wool fabric of Example I are thoroughly impregnated with each coreactant system under both anhydrous and regain moisture conditions. Fabrics classed as anhydrous are dried for 15 minutes at 250° F. and cooled in a dessicator, from which it is removed immediately prior to impregnation. These samples are designated by the letter "A" in Table III. Fabrics designated by the letter "B" contain regain levels of moisture at the time of impregnation. The pickup of the pre-polymer on the fabric in each instance is 2.0%, while the pickup of the N-methyl morpholine catalyst is 0.04%. All fabric samples are cured for 15 minutes and aged for 24 hours prior to testing as in Example I for relaxation and felting shrinkage values.

TABLE III

| Designation | Coreactant | Pickup (%) Dry Basis: Pre-polymer | Pickup (%) Dry Basis: Coreactant | Area Shrinkage (%): Relax | Area Shrinkage (%): Felt |
|---|---|---|---|---|---|
| Control | — | — | — | 16.1 | 46.3 |
| A | 1,4-butane diol | 2.0 | 0.09 | 9.5 | 5.3 |
| B | 1,4-butane diol | " | 0.09 | 5.5 | 4.0 |
| A | methyl diethanolamine | " | 0.1 | 7.8 | 2.8 |
| B | methyl diethanolamine | " | 0.1 | 4.5 | 2.7 |
| A | trimethylol propane | " | 0.09 | 9.2 | 4.6 |
| B | trimethylol propane | " | 0.09 | 5.2 | 5.2 |
| A | triethanolamine | " | 0.10 | 7.7 | 0.8 |
| B | triethanolamine | " | 0.10 | 4.1 | 3.3 |
| A | azelaic acid | " | 0.19 | 9.2 | 1.2 |
| B | azelaic acid | " | 0.19 | 5.4 | 2.1 |
| A | Pimelic | 8.0 | 0.16 | 0.3 | 7.8 |
| B | Pimelic | 8.0 | 0.16 | 6.5 | 8.6 |
| A | citric acid | 2.0 | 0.10 | 7.0 | 10.8 |
| B | citric acid | " | 0.10 | 6.5 | 21.7 |
| A | MOCA* | " | 0.27 | 7.3 | 3.2 |
| B | MOCA* | " | 0.27 | 4.7 | 3.5 |
| A | 1,6-hexamethylenediamine | " | 0.12 | 6.2 | 2.0 |
| B | 1,6-hexamethylenediamine | " | 0.12 | 3.9 | 2.5 |
| A | 2,6-diamino-pyridine | " | 0.11 | 8.3 | 2.8 |
| B | 2,6-diamino pyridine | " | 0.11 | 4.7 | 3.2 |
| A | 3,3'-diamino-dipropylamine | " | 0.09 | 3.2 | 2.4 |
| B | 3,3'-diamino-dipropylamine | " | 0.09 | 3.4 | 1.9 |
| A | triethylene-tetramine | " | 0.07 | 7.7 | 0.4 |
| B | triethylene-tetramine | " | 0.07 | 2.6 | 2.0 |

Pre-polymers are prepared from polypropylene glycols having molecular weights of about 1,200, 3,000 and 4,000. The procedure for polymerization is the same in all cases as that described for Example I; however, the amounts of ingredients added are modified to compensate for differences in the hydroxyl numbers of these glycols.

| | Parts by Weight |
|---|---|
| Formulation for polypropylene glycol 1200: | |
| PPG 1200 | 386.00 |
| L45 Silicone | 0.15 |
| Water | 1.30 |
| (1st. addition) Toluylene 2,4-diisocyanate | 81.30 |
| (2nd. addition) Toluylene 2,4-diisocyanate | 117.00 |
| Formulation for polypropylene glycol 3000: | |
| PPG 3000 | 492.50 |
| L45 Silicone | 0.07 |
| Water | 1.31 |
| (1st. addition) Toluylene 2,4-diisocyanate | 47.00 |
| (2nd. addition) Toluylene 2,4-diisocyanate | 89.50 |
| Formulation for polypropylene glycol 4000 A: | |
| PPG 4000 | 527.00 |
| L45 Silicone | 0.05 |
| Water | 1.05 |
| (1st. addition) Toluylene 2,4-diisocyanate | 37.60 |
| (2nd. addition) Toluylene 2,4-diisocyanate | 71.00 |
| Formulation for polypropylene glycol 4000 B: | |
| PPG 4000 | 527.00 |
| L45 Silicone | 0.05 |
| Water | 1.05 |
| (1st. addition)Toluylene 2,4-diisocyanate | 37.60 |
| (2nd. addition) Toluylene 2,4-diisocyanate | 35.50 |

The viscosities of the above pre-polymers as 70% solutions in trichloroethylene are about 5,250, 400, 1,200 and 1,050 centipoises respectively (Brookfield viscosimeter spindle #2).

EXAMPLE IX

The 70% pre-polymer solutions prepared from the various molecular weight glycols are compounded using the method described in Example I. Swatches of the all-wool fabric of Example I are treated with these solutions to obtain the pickups noted in Table IV. The swatches are then dried for 5 minutes at 160° F., cured 5 minutes at 250° F. and allowed to age 48 hours prior to testing as set forth in Example I.

TABLE IV

| Glycol from which pre-polymer is formed | Approx. molecular weight | Pickup (%) Quadrol | Pickup (%) Pre-Polymer | Area Shrinkage (%) Relaxation | Area Shrinkage (%) Felting |
|---|---|---|---|---|---|
| Control-none | — | — | — | 16.1 | 46.3 |
| Polypropylene Glycol (1200) | 1200 | .204 | 2.75 | 5.8 | 4.9 |
| | 1200 | .256 | 3.5 | 4.1 | 3.3 |
| | 1200 | .31 | 4.25 | 4.2 | 3.0 |
| Polypropylene Glycol (3000) | 3000 | .204 | 2.75 | 4.7 | 8.4 |
| | 3000 | .256 | 3.5 | 4.6 | 5.4 |
| | 3000 | .31 | 4.25 | 4.9 | 4.3 |
| Polypropylene Glycol (4000 A) | 4000 | .204 | 2.75 | 5.1 | 6.2 |
| | 4000 | .256 | 3.5 | 4.2 | 3.7 |
| | 4000 | .31 | 4.25 | 4.4 | 3.8 |

EXAMPLE X

The pre-polymer designated 4000 B is compounded with and without an added excess of toluylene-2,4-diisocyanate and with and without Quadrol as indicated in Table V. Swatches of the all-wool fabric of Example I are treated with the solutions to obtain the pickups shown in Table V. The swatches are dried for 5 minutes at 160° F., cured for 5 minutes at 250° F. and allowed to age for 48 hours prior to testing for shrinkage values.

TABLE V

| Pickup (%) Dry Basis: Pre-Polymer (4000 B) | Excess Diisocyanate Added | Quadrol | Area Shrinkage (%) Relaxation | Felting |
|---|---|---|---|---|
| — | — | — | 16.1 | 46.3 Control |
| 3.4 | 0.20 | — | 9.9 | 42.8 |
| 2.0 | — | — | 7.8 | 45.2 |
| 3.4 | 0.20 | 0.15 | 3.2 | 7.3 |
| 2.0 | — | 0.10 | 5.1 | 24.5 |

EXAMPLE XI

In this example, the effect of varying the ratio of —NCO groups to —OH groups in the compound is shown. To the pre-polymer of Example I are added varying amounts of Quadrol as shown in Table VI. Swatches of the fabric of Example I are impregnated with dilute solutions to obtain the pickups shown in Table VI, dried for 5 minutes at 160° F. and cured for 5 minutes at 250° F. After aging for 18 hours the swatches are tested for shrinkage values as in Example I. Treatments conducted on pre-dried fabrics are designated by the letter "A", whereas treatments conducted on fabrics containing regain levels of water are designated by the letter "B".

TABLE VI

| Designation | Pickup (%) Pre-Polymer | Pickup (%) Quadrol | NCO/OH Ratio | Area Shrinkage (%) Relaxation | Area Shrinkage (%) Felting |
|---|---|---|---|---|---|
| Control | — | — | — | 16.1 | 46.3 |
| A | 3.0 | 0.51 | 1.0 | 5.9 | 10.2 |
| B | 3.0 | 0.51 | 1.0 | 4.5 | 9.2 |
| A | 3.0 | 0.72 | 0.70 | 5.5 | 11.0 |
| B | 3.0 | 0.72 | 0.70 | 4.9 | 9.5 |
| A | 3.0 | 1.27 | 0.40 | 9.1 | 48.7 |
| B | 3.0 | 1.27 | 0.40 | 10.3 | 48.5 |
| A | 3.0 | 0.39 | 1.30 | 5.4 | 8.3 |
| B | 3.0 | 0.39 | 1.30 | 3.8 | 8.7 |
| A | 3.0 | 0.3 | 1.7 | 6.2 | 6.9 |
| B | 3.0 | 0.3 | 1.7 | 5.0 | 7.9 |
| A | 3.0 | 0.25 | 2.0 | 6.0 | 6.9 |
| B | 3.0 | 0.25 | 2.0 | 5.1 | 7.1 |
| B | 2.0 | 0.15 | 2.3 | 3.9 | 4.6 |
| B | 2.0 | 0.10 | 3.4 | 5.1 | 3.7 |
| B | 2.0 | 0.06 | 6.1 | 5.8 | 2.8 |
| B | 2.0 | 0.01 | 33.0 | 9.0 | 2.5 |

In the following Examples, the various components are mixed together in a common solvent without previous heating or otherwise encouraging pre-polymerization of the components before application to the fabrics.

In preparing these solutions, the polymeric polyhydroxy compound is first diluted below about 20% in trichloroethylene. The polyfunctional isocyanate is also diluted to this level, as are the coreactants and catalysts where utilized. These solutions may then be mixed to provide the desired proportion of the various components. The resulting solution is diluted further with trichloroethylene, depending upon the wet pickup obtained on application of the various solutions to the fabric, to obtain the desired amount of pickup (on a dry basis) of the various components on the fabric.

EXAMPLE XII

Various solutions in trichloroethylene of toluylene-2,4-diisocyanate, various polymeric polyols, Quadrol and catalyst are prepared and padded onto swatches of the all-wool fabric of Example I to provide the levels of pickup (dry basis) shown in Table VII. Half of the swatches are cured for 5 minutes at 250° F. (designated by the letter "C"), the remainder being cured for 15 minutes at 250° F. (designated by the letter "D"), prior to testing for shrinkage values in accordance with Example I.

The amount of diisocyanate in this Example is kept low in order to show more distinctly the differences in the effect of the different polymeric polyols. The higher shrinkage values shown herein can be readily lowered by increasing the diisocyanate level to about 2–4%. This technique, however, is unnecessary even at very low levels of diisocyanate usage when the triols are utilized, in that excellent shrinkage control is already provided, even at these low levels.

TABLE VII

| Designation | Solution: Polymeric Polyol* - Approx. Molecular Weight | Pick-up (%) Dry Basis: Diisocyanate | Polyol | Catalyst* | Quadrol | Area Shrinkgage (%) Relax | Felting |
|---|---|---|---|---|---|---|---|
| | Control | — | — | — | — | 16.1 | 46.3 |
| C | PEG - 200 | 1.65 | 0.85 | 0.147-NMM 0.0445-TMBDA 0.029 SO | 0.18 | 3.6 | 12.2 |
| D | PEG - 200 | 1.65 | 0.85 | " | 0.18 | 4.0 | 14.0 |
| C | PEG - 450 | 1.27 | 1.23 | " | 0.18 | 4.4 | 24.9 |
| D | PEG - 450 | 1.27 | 1.23 | " | 0.18 | 3.9 | 30.5 |
| C | PEG - 1000 | 0.94 | 1.56 | " | 0.18 | 4.3 | 13.0 |

TABLE VII-continued

| Designation | Solution Polymeric Polyol* - Approx. Molecular Weight | Pick-up (%) Dry Basis Diisocyanate | Polyol | Catalyst* | Quadrol | Area Shrinkgage (%) Relax | Felting |
|---|---|---|---|---|---|---|---|
| D | PEG - 1000 | 0.94 | 1.56 | " | 0.18 | 4.5 | 17.4 |
| C | PEG - 1150 | 0.98 | 1.52 | " | 0.18 | 4.4 | 15.6 |
| D | PEG - 1150 | 0.98 | 1.52 | " | 0.18 | 4.4 | 18.6 |
| C | PEG - 1450 | 0.82 | 1.68 | " | 0.18 | 4.2 | 12.00 |
| D | PEG - 1450 | 0.82 | 1.68 | " | 0.18 | 4.0 | 21.4 |
| C | PEG - 20.000 | 0.53 | 1.97 | " | 0.18 | 6.5 | 17.7 |
| D | PEG - 20.000 | 0.53 | 1.97 | " | 0.18 | 4.8 | 21.7 |
| C | PBG - 500 | 1.22 | 1.28 | " | 0.18 | 4.0 | 9.4 |
| D | PBG - 500 | 1.22 | 1.28 | " | 0.18 | 5.7 | 9.1 |
| C | PBG - 1000 | 0.94 | 1.56 | " | 0.18 | 5.3 | 3.3 |
| D | PBG - 1000 | 0.94 | 1.56 | " | 0.18 | 4.6 | 3.5 |
| C | PBG - 1500 | 0.81 | 1.69 | " | 0.18 | 5.3 | 4.0 |
| D | PBG - 1500 | 0.81 | 1.69 | " | 0.18 | 4.4 | 6.9 |
| C | PBG - 2000 | 0.75 | 1.75 | " | 0.18 | 4.6 | 11.4 |
| D | PBG - 2000 | 0.75 | 1.75 | " | 0.18 | 4.2 | 4.6 |
| C | PBG - 400 | 1.32 | 1.18 | " | 0.18 | 3.8 | 29.9 |
| D | PPG - 400 | 1.32 | 1.18 | " | 0.18 | 4.9 | 18.0 |
| C | PPG - 1200 | 0.88 | 1.62 | " | 0.18 | 5.1 | 3.4 |
| D | PPG - 1200 | 0.88 | 1.62 | " | 0.18 | 4.6 | 4.1 |
| C | PPG - 3000 | 0.67 | 1.83 | " | 0.18 | 4.0 | 4.1 |
| D | PPG - 3000 | 0.67 | 1.83 | " | 0.18 | 4.9 | 4.8 |
| C | PPG - 4000 | 0.63 | 1.87 | " | 0.18 | 8.2 | 36.5 |
| D | PPG - 4000 | 0.63 | 1.87 | " | 0.18 | 6.9 | 35.8 |
| C | PPG - 2000 | 0.75 | 1.75 | " | 0.18 | 6.2 | 9.3 |
| D | PPG - 2000 | 0.75 | 1.75 | " | 0.18 | 4.6 | 8.8 |
| C | Niax LG 56-3000 | 0.74 | 1.76 | " | 0.18 | 4.2 | 24.8 |
| D | Niax LG 56-3000 | 0.74 | 1.76 | " | 0.18 | 4.8 | 3.2 |
| C | Niax triol LHT 42-4400 | 0.84 | 1.66 | " | 0.18 | 4.4 | 3.5 |
| D | Niax triol LHT 42-4400 | 0.84 | 1.66 | " | 0.18 | 4.4 | 3.7 |
| C | Triol G-4000 | 0.69 | 1.81 | " | 0.18 | 4.6 | 4.1 |
| D | Triol G-4000 | 0.69 | 1.81 | " | 0.18 | 3.6 | 4.3 |
| C | Actol 32-1000 | 1.34 | 1.16 | " | 0.18 | 3.6 | 3.4 |
| D | Actol 32-1000 | 1.34 | 1.16 | " | 0.18 | 4.1 | 4.4 |

*NMM - N-methyl morpholine
TMBDA - trimethylbutanediamine
SO - stannous octoate
PEG - polyethylene glycol
PBG - polybutylene glycol
PPG - polypropylene glycol
Niax - tradename for polymeric triols
Actol - tradename for polymeric triols

EXAMPLE XIII

Various solutions in trichloroethylene containing toluylene-2,4-diisocyanate, varying amounts of Quadrol, various polymeric polyols, and catalyst are padded onto swatches of the fabric of Example I to provide the levels of pickup shown in Table VIII. The samples designated by the letter "C" are cured for 5 minutes at 250° F. and aged for 24 hours prior to testing for shrinkage, and the samples designated by the letter "D" have been cured for 15 minutes and aged for 18 hours prior to testing for shrinkage. These "D" swatches were also scoured prior to testing.

TABLE VIII

| Designation | Polymeric Polyol | Pick-up (%) Dry Basis Diisocyanate | Polyol | Catalyst * | Quadrol | Area Shrinkage (%) Relaxation | Felting |
|---|---|---|---|---|---|---|---|
| | Control | — | — | — | — | 16.1 | 46.3 |
| C | PBG - 1000 | 1.14 | 1.89 | 0.147 NMM 0.0145 TMBDA 0.03 SO | 0.22 | 0.6 | 2.9 |
| D | PBG - 1000 | 1.14 | 1.89 | " | 0.22 | 1.1 | 5.0 |
| C | PPG - 3000 | 0.81 | 2.21 | " | 0.22 | 1.4 | 3.1 |
| D | PPG - 3000 | 0.81 | 2.21 | " | 0.22 | 1.1 | 11.5 |
| C | Actol 32-160 | 1.62 | 1.40 | " | 0.22 | 1.4 | 5.2 |
| D | Actol 32-160 | 1.62 | 1.40 | " | 0.22 | 1.2 | 17.3 |
| C | Actol 32-160 | 1.32 | 1.71 | " | 0.22 | 1.0 | 4.7 |
| D | Actol 32-160 | 1.32 | 1.71 | " | 0.22 | 0.4 | 14.8 |

EXAMPLE XIV

A solution in trichloroethylene, diluted as in Example XII, is prepared to contain 100 parts toluylene-2,4-diisocyanate, 20.8 parts Quadrol, and 186 parts polypropylene glycol of a molecular weight of about 1200. Various catalyst systems are added to similar solutions and padded onto swatches of the all-wool fabric of Example I. The pickup on the fabric of the diisocyanate is 1.06%, the Quadrol 0.22%, and the glycol 1.97%. Each fabric is dried for 5 minutes at 160° F. and then cured at 250° F. for the periods set forth in Table IX and aged for 24 hours prior to testing for shrinkage values. Once again the letters "C" and "D" are used to designate 5 and 15 minute cures at 250° F., respectively. The "D" swatches are scoured prior to testing.

TABLE IX

| Designation | Catalyst | Cure Time (Minutes) | Area Shrinkage (%) Relaxation | Felting |
|---|---|---|---|---|
| | Control | — | 16.1 | 46.3 |
| C | None | 5 | 2.1 | 19.2 |
| D | None | 15 | 0.8 | 33.8 |
| C | Stannous octoate | | | |

TABLE IX-continued

| Designation | Catalyst | Cure Time (Minutes) | Area Shrinkage (%) Relaxation | Felting |
|---|---|---|---|---|
| | 0.96 parts, Trimethyl-butane diamine 0.48 parts | 5 | 1.2 | 4.3 |
| D | " | 15 | 1.2 | 15.3 |
| C | Stannous octoate 0.96 | 5 | 1.4 | 4.0 |
| D | " | 15 | 1.5 | 22.7 |
| C | N-methyl morpholine 4.83 parts, Stannous octoate 0.96 parts, Trimethyl-butane diamine 0.48 parts | 5 | 1.5 | 4.2 |
| D | " | 15 | 1.5 | 16.0 |
| C | N-methyl morpholine 4.83 parts, Trimethyl-butane diamine 0.48 parts | 5 | 2.1 | 16.5 |
| D | " | 15 | 1.9 | 31.0 |
| C | N-methyl morpholine 4.83 parts, Stannous octoate 0.96 parts | 5 | 1.2 | 3.6 |
| D | " | 15 | 1.2 | 12.0 |

The felting shrinkage values of those samples containing regain levels of water may be decreased by adding additional diisocyanate to the system. These results are inferior to the anhydrous samples because the ratio of NCO groups to total —OH (including —OH from the water in the fabric) is lower than in the anhydrous samples.

EXAMPLE XV

Into solutions in trichoroethylene containing 100 parts of toluylene-2,4-diisocyanate and 186 parts of polypropylene glycol (having a molecular weight of about 1200) are added various coreactants. The solutions, which are diluted with trichloroethylene to about 3% solids, also contain the catalyst system of Example XII. These solutions are padded on samples of the all-wool fabric of Example I to obtain a pickup of 1.06% diisocyanate, 1.97% polypropylene glycol, and the same amounts of catalyst as in Example XII and the amounts of coreactant shown in Table X. The impregnated fabrics are then dried for 5 minutes at 160° F. and cured at 250° F. for the periods set forth in Table X and aged for 24 hours prior to testing for shrinkage values. This drying at a low temperature (160° F.) and curing at a higher temperature is for the purpose of simplification of solvent recovery.

When 1,6-hexane diamine is used, this coreactant is padded onto the fabric, after which it is dried and the toluylene-2,4-diisocyanate/polypropylene glycol/-catalyst system is padded onto the fabric. This two-step technique is utilized because the combined system has a short pot life. The letters "C" and "D" are used as in the prior example.

TABLE X

| Designation | Coreactant | Pickup Coreactant (%) | Cure Time (Mins.) | Area Shrinkage (%) Relaxation | Felting |
|---|---|---|---|---|---|
| | Control | — | — | 16.1 | 46.3 |
| C | 1,6-hexane diamine | 0.18 | 5 | 2.1 | 4.7 |
| D | " | 0.18 | 15 | 1.9 | 5.3 |
| C | Azelaic acid | 0.29 | 5 | 5.0 | 41.8 |
| D | " | 0.29 | 15 | 1.2 | 43.1 |
| C | Methyl diethanolamine | 0.18 | 5 | 3.8 | 39.2 |
| D | " | 0.18 | 15 | 3.1 | 44.1 |

TABLE X-continued

| Designation | Coreactant | Pickup Coreactant (%) | Cure Time (Mins.) | Area Shrinkage (%) Relaxation | Felting |
|---|---|---|---|---|---|
| C | Triethanolamine | 0.15 | 5 | 1.1 | 8.3 |
| D | " | 0.15 | 15 | 1.0 | 7.5 |

EXAMPLE XVI

Various solutions in trichloroethylene containing 100 parts of toluylene-2,4-diisocyanate and 130 parts of the triol Actol 32–160, with and without a coreactant as set forth in Table XI, and containing the same amounts of catalyst system of Example XII, are padded onto swatches of the all-wool fabric of Example I. In the case of 1,6-hexane diamine, the diisocyanate/Actol solution is padded separately and after drying, the 1,6-hexane diamine is padded onto the fabric and dried. In the other tests in this example, the coreactant is added directly to the compound solution. Those tests designated by the letter "C" are dried for 5 minutes at 160° F. and cured for 5 minutes at 250° F. and aged 24 hours prior to testing for shrinkage values. Those tests designated by the letter "D" are dried in the same manner and cured for 15 minutes at 250° F., aged 24 hours and then scoured prior to testing for shrinkage values. The impregnated fabric picks up 1.32% diisocyanate, 1.71% Actol and varying amounts of coreactant as set forth in Table XI.

TABLE XI

| Designation | Coreactant | Pickup of Coreactant (%) | Area Shrinkage (%) Relaxation | Felting |
|---|---|---|---|---|
| | Control | — | 16.1 | 46.3 |
| C | Quadrol | 0.22 | 1.3 | 6.2 |
| D | Quadrol | " | 2.0 | 13.9 |
| C | 1,6-hexane diamine | 0.18 | 1.4 | 3.4 |
| D | diamine | " | 1.0 | 3.0 |
| C | Azelaic acid | 0.29 | 1.5 | 4.3 |
| D | Azelaic acid | " | 1.9 | 7.1 |
| C | Methyl diethanolamine | 0.18 | 1.9 | 3.9 |
| D | diethanolamine | " | 1.3 | 6.5 |

EXAMPLE XVII

A solution in trichloroethylene containing 100 parts of toluylene-2,4-diisocyanate, 205 parts polyethylene glycol of a molecular weight of about 1450, 22 parts Quadrol, 4.83 parts N-methyl morpholine, 0.96 parts stannous octoate, and 0.48 parts of trimethylbutanediamine is padded onto various swatches of the all-wool fabric of Example I to provide a pickup on the fabrics of 1.22% diisocyanate, 2.50% polyethylene glycol, 0.27% Quadrol, 0.147% N-methyl morpholine, 0.03% stannous octoate and 0.0145% trimethylbutanediamine. These fabrics are then dried and cured under the conditions set forth in Table XII, after which they are aged for 24 hours at room conditions, in the same manner as preceding Examples, before testing for shrinkage values.

TABLE XII

| Cure Conditions | Area Shrinkage (%) Relaxation | Felting |
|---|---|---|
| Control | 16.1 | 46.3 |
| No heat treatment--24 hours aging | 2.7 | 25.2 |
| 2 minutes at 250° F.--24 hours aging | 2.5 | 11.9 |
| 5 minutes at 250° F.--24 hours aging | 2.1 | 11.2 |

TABLE XII-continued

| Cure Conditions | Area Shrinkage (%) Relaxation | Felting |
|---|---|---|
| 5 minutes at 220° F.--24 hours aging | 2.7 | 14.3 |
| 5 minutes at 190° F.--24 hours aging | 4.1 | 16.9 |

The impregnated fabric is dried for 5 minutes at 160° F., after which the fabric is cured for 10 minutes at 250° F. For comparison, a swatch of the same fabric, though untreated, is given a typical chlorination treatment for shrinkage control. The area shrinkage and various properties of these fabrics are measured and shown in Table XIII.

TABLE XIII

| Fabric | Pickup (%) Dry Basis Pre-polymer | Quadrol | Area Shrinkage (% Relax | Felting | Tensile Strength (lbs) Instron Warp | Filling | Elongation (%) Instron Warp | Filling | Tongue Tear Strength (grams) Instron Warp | Filling | Flex Abrasion (cycles) Warp | Fill | Flat Abrasion (cycles) |
|---|---|---|---|---|---|---|---|---|---|---|---|---|---|
| Untreated Control | — | — | 16.0 | 36.7 | 33.4 | 21.3 | 34.0 | 29.3 | 1274 | 1007 | 234 | 111 | 596 |
| Chlorinated Control | — | — | 9.3 | 2.5 | 26.8 | 15.5 | 26.0 | 27.3 | 1243 | 866 | 128 | 63 | 408 |
| Treated Fabric | 2.87 | 0.23 | 4.2 | 1.4 | 40.5 | 26.0 | 35.6 | 30.6 | 1302 | 1001 | 510 | 272 | 826 |

The level of pickup in this Example is reduced to show more distinctly the effect of different curing conditions.

EXAMPLE XVIII

There is prepared a solution in trichloroethylene containing 100 parts of toluylene-2,4-diisocyanate, 130 parts of the triol Actol 32–160, 16.5 parts Quadrol, 4.83 parts N-methyl morpholine, 0.48 parts trimethylbutanediamine, and 0.96 parts cobalt naphthenate. This solution is diluted further with trichloroethylene and then padded onto a sample of the all-wool fabric of Example I to obtain a pickup of 1.32% diisocyanate, 1.71% Actol, 0.22% Quadrol, and the same amounts of catalyst as in Example XII. The fabric is then divided into 2 swatches, one of which is cured for 5 minutes at 250° F., the other of which is cured for 15 minutes at 250° F., after which both are aged 24 hours prior to testing for shrinkage values. The fabric swatch which is cured for 5 minutes has a relaxation shrinkage of 2.5%, while the swatch cured for 15 minutes has a relaxation shrinkage of 2.7%.

EXAMPLE XIX

There is prepared a solution in trichloroethylene containing 100 parts hexamethylene diisocyanate, 135 parts of the triol Actol 32–160, 17.4 parts Quadrol, 4.83 parts N-methyl morpholine, 0.48 parts trimethylbutanediamine, and 0.96 parts stannous octoate. This solution is diluted further with trichloroethylene and padded onto a swatch of the all-wool fabric of Example I to obtain a pickup of 1.27% diisocyanate, 1.71% Actol, 0.22% Quadrol, 0.14% N-methyl morpholine, 0.0145% trimethylbutanediamine, and 0.029% stannous octoate. The fabric is then divided and half of it is cured for 5 minutes at 250° F., the other half being cured for 15 minutes at 250° F., after which both fabrics are aged for 48 hours prior to testing for shrinkage values. The fabric cured for 5 minutes has a relaxation shrinkage of 1.7% and a felting shrinkage of 9.5% whereas the fabric treated for 15 minutes has a relaxation shrinkage of 1.7% and a felting shrinkage of 10.9% compared to the untreated control which has a relaxaticn shrinkage of 16.1% and a felting shrinkage of 46.3%.

EXAMPLE XX

An all-wool fabric similar to that used in Example I, but having two more ends and two more picks per inch is impregnated with a trichloroethylene solution of the pre-polymer of Example I and Quadrol to a pickup on the fabric of 2.87% pre-polymer and 0.23% Quadrol.

EXAMPLE XXI

The all-wool fabric of Example XX is impregnated with a pre-polymer solution as in Example I to a pickup of 3.0% pre-polymer, 0.22% Quadrol, and 0.3% silicone finish. The fabric is then dried for 5 minutes at 160° F., folded over upon itself and placed in a Hoffman press, where it is subjected to 30 seconds pressing under steam, held in the press for 30 seconds without steaming, after which the fabric is held for an additional 10 seconds under vacuum. The creased fabric is removed and given an additional cure for 10 minutes at 250° F. while still holding it in a creased condition.

After aging about 18 hours, the creased fabric is immersed in water containing 0.1% Surfonic N-95, a nonionic wetting agent for 30 minutes at 170° F., dried in an open condition and the crease evaluated subjectively. In a crease rating system, wherein the best crease is given a rating of 5.0, a flat fabric having a rating of 1.0, the above-creased fabric has a rating of 5.0.

A swatch of the same fabric is impregnated to the same levels of pickup, dried as before, cured for 10 minutes at 250° F. and creased and tested as before. The fabric treated in this manner has a rating of 1.0.

In another test, a swatch of the same fabric is creased in a Hoffman press in the same manner as before, then impregnated, dried and cured as before. The fabric treated in this manner has a crease rating of 5.0.

EXAMPLE XXII

A single yarn is removed from the treated fabric of Example XX and embedded in the epoxy resin Araldite, which is then cured. A cross-section, about 1500 Angstrom units thick, is cut from the resin body whereby the yarn cross-section is exposed. The cross-section is then examined through an electron microscope set at 1300 magnification. No visible coating on individual fibers is seen under these conditions. Photographs taken at this magnification are enlarged 5000 diameters and again, no visible coating is seen on individual fibers. Photomicrographs at 50,000 diameters also fail to show a visible coating.

EXAMPLE XXIII

Samples of the all-wool fabric of Example I are padded with an aqueous emulsion of a blocked isocyanate-terminated prepolymer sold by Thiokol Co. as JL-2 Emulsion. The pickup of the prepolymer on the fabric is 5%.

The impregnated fabric is dried for 20 minutes at 212° F., after which the dried fabric is cured at 310° F., for 3 minutes to dissociate the prepolymer.

The fabric so treated has a relaxation shrinkage value of 1.0% and a felting shrinkage value, as determined from 3 thirty-minute washes in an automatic washer, of 1.1%.

When this procedure is repeated at a 3% level of pickup of the blocked pre-polymer, the relaxation and felting shrinkage values are 1.8 and 4.6%, respectively.

The untreated control values are 10.6 and 14.1%, respectively.

EXAMPLE XXIV

The procedure of Example XXIII is repeated, except that Thiokol's Emulsion D-95407-JL is substituted for the emulsion of Example XXIII. Relaxation and felting shrinkage values at the 5% pickup level are 0.5 and 1.0%, respectively; at the 3% level, 0.2 and 1.8% respectively.

EXAMPLE XXV

The prepolymers of Examples XXIII and XXIV are separated from the emulsions and dissolved in ethyl acetate. Fabric samples are treated with these solutions as in Example XXIII. Slightly improved results at lower pickup levels are obtained in this manner. The handle of these fabrics is superior to that of fabrics treated by the water-based systems.

EXAMPLE XXVI

A mixture of diisocyanate isomers containing 80% toluylene-2,4-diisocyanate and 20% toluylene-2,6-diisocyanate are blocked by the addition thereto, in stoichiometric amounts, of the various active hydrogen compounds dissolved in the various solvents containing certain catalysts, as set forth in Table XIV.

After the heat of reaction subsides, the resulting solutions are heated at 80° C. for 3 hours. The resulting hot solutions are diluted to 10% solids with additional solvent heated to the same temperature, after which 10% trichloroethylene solutions of polypropylene glycol having an approximate molecular weight of 2000 and containing Quadrol, trimethylbutanediamine, and tin octoate are added thereto. The resulting systems are diluted with a 1/1 solution of trichloroethylene and the particular solvent used during blocking, so that at 135% wet pickup during padding onto the fabric of Example I, the following dry weights of compounds are applied: 2.46% polypropylene glycol, 0.28% Quadrol, 0.0445% trimethylbutanediamine, 0.029% tin octoate end sufficient blocked isocyanate to provide 1.30% of the active isocyanate compound.

The impregnated fabric is then dried and cured at the temperature given in Table XIV.

In each instance, the relaxation and felting shrinkage of the fabric samples are greatly inhibited.

TABLE XIV

| Blocking Agent | Solvent | Catalyst | Curing Temperature (° C) |
|---|---|---|---|
| Ethanol | Ethanol | None | 160 |
| 2-Methyl-2-propanol | Toluene | Triethylamine | 150 |
| m-Cresol | Benzene | Triethylamine | 95 |
| o-Nitrophenol | Toluene | Triethylenediamine | 85 |
| o-Chlorophenol | Chloroform | Triethylenediamine | 65 |
| Guaiacol | Chloroform | Triethylamine | 100 |
| Resorcinol | Dioxane | Triethylamine | 90 |
| Phloroglucinol | Dioxane | Triethylamine | 120 |
| 1-Dodecanethiol | Toluene | Triethylamine | 120 |
| Benzenethiol | Chloroform | Triethylenediamine | 100 |
| Ethyl acetoacetate | Toluene | Sodium Methoxide | 100 |
| Diethyl malonate | Toluene | Sodium Methoxide | 95 |
| ε-Caprolactam | Toluene | Triethylenediamine | 150 |
| Ethyl Carbamate | Carbon Tetrachloride | Triethylamine | 135 |
| Boric Acid | Tetrahydrofuran | None | 85 |

Substantially similar results are obtained when these active hydrogen compounds are utilized to block the prepolymer of Example I and this blocked prepolymer is applied to the fabric and cured under the same conditions.

EXAMPLE XXVII

The systems of Example XXVI produce substantially similar results when applied from an aqueous emulsion, although the fabrics so treated have slightly harsher handle.

Dry crease performance data are obtained in the following Examples from presensitized fabric samples having dimensions of 4½ inches in the filling direction by 6 inches in the warp direction. These samples are folded in half with the fold parallel to the warp yarns. The samples are then placed on a Hoffman press, the cover is closed and locked and the samples are pressed for the periods of time indicated in the Example, generally with 30 seconds top steam, 30 seconds baking followed by 10 seconds vacuuming.

The creased samples are then opened and placed in a standing water batch which contains a wetting agent and is heated to 170° F. After 30 minutes the samples are removed, folded along their original crease line and allowed to air dry. After drying, the creases remaining in the samples are rated subjectively by at least three observers, the crease ratings running from 1 (no appreciable crease) to 5 (very sharp crease).

EXAMPLE XXVIII

A trichloroethylene solution containing 8.9 grams of the prepolymer of Example I, 0.9 grams Quadrol, 0.62 grams of silicone resin 1172 is padded onto a sample of Deering Milliken woolen fabric style No. 477 to 145% wet pickup. After drying for 5 minutes at 160° F., the fabric is folded and creased on a Hoffman press using a pressing cycle of 30 seconds steam, 30 seconds bake followed by 10 seconds of vacuum. The creased fabric is removed and, while maintained in a creased configuration, is cured for 5 minutes at 250° F. After ageing overnight, the fabric is tested as set forth above. The crease rating of this fabric is 5.0, the highest possible rating.

EXAMPLE XXIX

A sample of the fabric of Example XXVIII is creased on a Hoffman press as set forth in Example XXVIII. The fabric, while still creased is padded to 145% wet pickup with the solution of Example XXVIII, dried for 5 minutes at 160° F. and cured for 5 minutes at 250° F. All operations are conducted while maintaining the fabric in its creased condition.

After ageing overnight and testing as set forth above, the crease rating is 5.0, the highest possible rating.

EXAMPLE XXX

Various swatches of an all-wool flannel fabric are padded with trichloroethylene solutions containing the prepolymer of Example I, Quadrol and the silicone resin of Example XXVIII to provide the pickup levels shown in Table XV. The fabric is then dried by heating for 5 minutes at 160° F., after which it is folded and pressed on a Hoffman press under the cycles set forth in Table XV, the periods of steaming and baking being shown. The fabric is then tested for crease retention after ageing for the periods of time set forth in Table XV, with and without an added heating step at 250° F. as set forth in Table XV.

TABLE XV

| Pickup (%) Prepolymer | Quadrol | Pressing Cycle (sec.) Silicone | Additional Steam | Bake | Before Testing Cure (min) | Ageing Time (hours) | Crease Rating |
|---|---|---|---|---|---|---|---|
| — | — | — | 30 | 30 | — | ⅓ | 1.0 |
| — | — | — | 30 | 30 | — | 18 | 1.0 |
| 2.0 | 0.15 | 0.20 | 30 | 30 | — | ¼ | 2.6 |
| 2.0 | 0.15 | 0.20 | 30 | 30 | — | 18 | 3.4 |
| 3.0 | 0.22 | 0.30 | 30 | 30 | — | ¼ | 3.3 |
| 3.0 | 0.22 | 0.30 | 30 | 30 | — | 18 | 3.8 |
| 4.0 | 0.29 | 0.35 | 30 | 30 | — | ¼ | 3.5 |
| 4.0 | 0.29 | 0.35 | 30 | 30 | — | 18 | 3.9 |
| 4.0 | 0.29 | 0.35 | 30 | 90 | — | ¼ | 3.6 |
| 4.0 | 0.29 | 0.35 | 30 | 180 | — | ¼ | 4.0 |
| 4.0 | 0.29 | 0.35 | 30 | 90 | 15 | ¼ | 4.5 |
| 4.0 | 0.29 | 0.35 | 30 | 180 | 15 | ¼ | 4.8 |
| 4.0 | 0 | 0.35 | 30 | 180 | 15 | ¼ | 1.5 |

EXAMPLE XXXI

Various wool fabrics are impregnated with trichloroethylene solutions of the prepolymer of Example I, Quadrol and silicone resin to provide the levels of pickup (dry basis) shown in Table XVI. These fabrics are dried for 5 minutes at 160° F. and heated for 10 minutes at 250° F. The fabrics are then creased as set forth in Example XXVIII, after a time lag as set forth in Table XVI. The fact that durable creases can be set in the fabric during the ageing period indicates that the curing step initiates the reaction between the various components and the keratin fibers to a substantial degree, but that the actual curing step proceeds for a considerable period of time after the heating operation, that is, curing continues over an extended period of time.

The fabrics designated A in Table XVI are 100% all-wool worsted fabrics, whereas the fabrics designated B in Table XVI are fabrics made from 5.5 run blends of 85% wool, 15% nylon.

TABLE XVI

| Fabric | Pickup (%) Prepolymer | Quadrol | Silicone | Time Lag Before Creasing (hours) | Crease Rating |
|---|---|---|---|---|---|
| A | — | — | — | — | 1.3 |
| B | — | — | — | — | 1.0 |
| A | 3.25 | 0.24 | 0.35 | Creased before heating for 10 minutes at 250° F. | 3.9 |
| B | 4.0 | 0.29 | 0.35 | Creased before heating for 10 minutes at 250° F. | 4.8 |
| A | 3.25 | 0.24 | 0.35 | ¼ | 3.5 |
| B | 4.0 | 0.29 | 0.35 | ¼ | 3.6 |
| A | 3.25 | 0.24 | 0.35 | 1 | 3.0 |
| B | 4.0 | 0.29 | 0.35 | 1 | 3.5 |
| A | 3.25 | 0.24 | 0.35 | 3 | 3.1 |
| B | 4.0 | 0.29 | 0.35 | 3 | 3.2 |
| A | 3.25 | 0.24 | 0.35 | 6 | 2.9 |
| B | 4.0 | 0.29 | 0.35 | 6 | 3.2 |
| A | 3.25 | 0.24 | 0.35 | 18 | 1.0 |
| B | 4.0 | 0.29 | 0.35 | 18 | 1.0 |

EXAMPLE XXXII

Substantially durable creases are obtained when all-wool fabric samples are treated in accordance with each of Examples I through XXVIII, but creased and cured as in Example XXVIII, the best results in crease retention being obtained in those fabric samples wherein both relaxation and felting shrinkage values are low. In the procedure of Example XXVI, the creases imparted to the fabric are substantially durable after creasing on the Hoffman press for those embodiments wherein the blocking agent comprises m-cresol, o-nitrophenol, o-chlorophenol, benzenethiol, ethyl acetoacetate, guaiacol, resorcinol, boric acid and diethyl malonate. Improved results are obtained, however, when the fabric is subjected to the heating operation at 250° F. for 5 minutes, since this temperature exceeds the unblocking temperature for these compounds and assures release of active isocyanate groups. For the blocked compounds that are activated at higher temperatures, e.g., wherein the blocking agent comprises ethanol, 2-methyl-2-propanol, phloroglucinol, 1-dodecanethiol, benzenethiol, ethyl acetoacetate, epsilon-caprolactam, and ethyl carbamate, the heating operation is conducted at the unblocking temperatures shown in Table XIV for the individual compounds.

EXAMPLE XXXIII

An all-wool fabric is impregnated with the solution of Example XXVIII to the same level of pickup. After drying at 160° F., the fabric is pressed by passing through a three roll calendar having a fiber-filled roll set between two steel rolls in a vertical arrangement. The fiber-filled roll is a 55/45, corn husk cotton filled roll. Temperatures of about 350° F. and pressures of about 80 tons, which correspond to 3200 lbs. per linear inch at the nip, are employed. The fabric is then full-decated by forcing steam through the fabric at 60 psig and holding for 10 minutes after breakthrough. The fabric so treated is found to have a high luster which is durable to steam sponging and wetting.

As noted above, the reactive components may all be applied to the fabric from a single solution, as by padding, spraying or the like, in a continuous process characterized by high levels of production. For example, since the fabric need be contacted with the solution for only so long a time as is necessary to impregnate the fabric, and this is very brief in that the organic solutions readily penetrate wool fabrics, production rates of 60 yards per minute or more with conventional padding equipment are entirely feasible.

The process of this invention may be utilized to inhibit the relaxation shrinkage of any wool fabric, including those fabrics which have been stretched and dried in stretched configuration to obtain increased yardage. Normally the increased yardage obtained in this manner is lost during any subsequent wetting, such as during treatment to reduce shrinkge by the prior art processes, or during sponging which is necessary on fabrics treated by conventional techniques to remove relaxation shrinkage from the fabric. The increased yardage obtained by stretching and drying in stretched configuration, however, is retained after treatment of these fabrics in accordance with this invention, because essentially no relaxation shrinkage occurs during treatment, as occurs in previous techniques involving water immersion. The resulting fabric, furthermore, remains resistant to relaxation shrinkage at later stages in its use, so that fabrics treated in accordance with this invention may be dyed, scoured or otherwise processed with no appreciable yardage loss as would occur when stretched fabrics treated by prior art processes are subjected to the same subsequent treatments. In addition, fabrics treated by the process of this invention may be delivered to the consumer ready for cutting into garments, without the necessity of sponging to stabilize the fabric dimensions.

All the above advantages and many others will become apparent to those practising this invention.

That which is claimed is:

1. A process for shrinkproofing a textile fabric containing keratin fibers which comprises impregnating said fabric with a isocyanate/polyether polyol composition containing a co-reactant having at least two groups containing at least one active hydrogen and combination thereof selected from the group consisting of —OH, —$NH_2$, —COOH, and —SH to provide a solids pickup of up to about 10% by weight, drying the treated fabric to remove substantially all of the liquid, and curing said treated fabric at a temperature sufficient to effect a reaction between the keratin fibers and the isocyanate/polyether polyol components of said composition; said isocyanate/polyether polyol composition being an aqueous or a non-isocyanate-reactive organic solvent composition containing a mixture of a isocyanate which is activated by heating at an elevated temperature and a polyether polyol, other than a polyol based on a natural occurring polymer, said isocyanate being blocked only when said composition is an aqueous composition.

2. The process of claim 1 wherein the reaction is conducted in the presence of a catalyst.

3. The process of claim 1 wherein the polyether polyol is a polyether diol or a triol.

4. The process of claim 1 wherein the polyol is a polyether diol.

5. The process of claim 1 wherein the isocyanate is an aryl diisocyanate.

6. The process of claim 1 wherein the polyol is a polyalkalene ether triol and the isocyanate is an aryl diisocyanate.

7. The process of claim 1 wherein the polyol is a polypropylene glycol and the isocyanate is a tolylene-2, 4-diisocyanate.

8. The process of claim 1 wherein said co-reactant is ethylene diamine.

9. The fabric prepared by the process of claim 1.

10. The process of claim 1 wherein said fabric is cut and sewn into a garment and the garment is arranged in a desired configuration prior to said curing.

11. The process of claim 1 wherein said polyisocyanate/polyether polyol composition is an aqueous composition.

12. The process of claim 1 wherein said polyisocyanate/polyether polyol is a non-reactive organic solvent composition.

13. A process for shrinkproofing a textile fabric containing keratin fibers comprising (a) impregnating said fabric with a non-reactive organic solvent solution containing
  (i) a monomeric polyfunctional isocyanate,
  (ii) a polyether polyol, to provide a solids pickup of up to about 10% by weight, and
  (iii) a catalyst for effecting the reaction between said polyfunctional isocyanate and said polyether polyol
(b) drying the treated fabric to remove substantially all of the solvent; and
(c) curing said fabric at a temperature which is sufficient to effect a reaction between the keratin fibers and the components of the organic solution.

14. The process of claim 13 wherein the composition also contains a co-reactant having at least two groups containing at least one active hydrogen atom.

15. The process of claim 13 wherein the polyol is a polyether diol.

16. The process of claim 13 wherein the isocyanate is an aryl diisocyanate.

17. A process for shrink-proofing a textile fabric containing keratin fibers comprising (a) impregnating said fabric with an aqueous composition comprising
  (i) a blocked isocyanate which is activated by heating at an elevated temperature,
  (ii) a polyether diol or a triol; and
  (iii) a catalyst for effecting the reaction between said isocyanate and the polyether constituent;
(d) drying the treated fabric to remove substantially all of the water, and
(c) curing said fabric at a temperature sufficient to effect a reaction between the keratin fibers and the components of the aqueous composition.

18. The fabric prepared by the process of claim 17.

19. A process for durably setting a fabric containing keratin fibers in a desired configuration comprising (a) impregnating said fibers with an organic solution containing a non-reactive organic solvent and
  (i) a polyfunctional isocyanate;
  (ii) a polyether polyol; and
  (iii) a catalyst for effecting the reaction between said polyfunctional isocyanate and said polyether polyol;
(b) fixing said impregnated fabric in the desired configuration, and
(c) heating said fabric, while maintaining it in the desired configuration, to a temperature sufficient to set the fabric.

20. A process for producing garments containing keratin fibers and being durably set in a desired configuration comprising (a) impregnating said fibers with an organic solution containing a non-reactive organic solvent and
  (i) a polyfunctional isocyanate;
  (ii) a polyether polyol; and
  (iii) a catalyst for effecting the reaction between said polyfunctional isocyanate and said polyether polyol;
(b) drying said fabric to remove substantially all of the liquid,
(c) cutting and sewing said fabric into a garment,
(d) arranging said garment in the desired configuration, and
(e) curing said agent while maintaining the garment in the desired configuration.

21. The process of claim 20 wherein the polyol is a polypropylene glycol having a molecular weight of about 2,000 and the isocyanate is tolylene 2, 4-diisocyanate.

22. The process of claim 21 wherein the composition also contains an ethylene diamine as a co-reactant.

23. A process for durably setting a fabric containing keratin fibers in a desired configuration comprising (a) impregnating said fibers with a non-reactive organic solvent solution containing
  (i) a monomeric polyfunctional isocyanate;
  (ii) a polyether polyol to provide a solids pickup of up to about 10% by weight; and
  (iii) a catalyst for effecting the reaction between said polyfunctional isocyanate and said polyether polyol;
(b) fixing said impregnated fabric in the desired configuration,
(c) drying said fabric to remove substantially all of the solvent, and
(d) heating said fabric while maintaining it in the desired configuration, to a temperature sufficient to set the fabric.

* * * * *

UNITED STATES PATENT OFFICE

CERTIFICATE OF CORRECTION

Patent No. 4,144,027 Dated March 13, 1979

Inventor(s) Emile E. Habib

It is certified that error appears in the above-identified patent and that said Letters Patent are hereby corrected as shown below:

Column 9, line 16, change "5,5" to --5,5'--.

Column 9, line 57, the word "sulfnydryl" should be --sulfhydryl--.

Column 10, line 14, the word "of" should be --for--.

Column 10, line 67, the word "in" should be --the--.

Column 14, lines 40-41, the word "p-ditolylamine" should be --p-ditolyl amine--.

Column 15, line 7, the word "wth" should be --with--.

Column 17, line 64, the word "silver" should be --sliver--.

Column 18, line 48, the word "wrap" should be --warp--.

CERTIFICATE OF CORRECTION

Patent No. 4,144,027 Dated March 13, 1979

Inventor(s) Emile E. Habib

It is certified that error appears in the above-identified patent and that said Letters Patent are hereby corrected as shown below:

Column 18, line 49, the word "filing" should be --filling--.

Column 18, line 55, the word "filing" should be --filling--.

Column 19, line 25, after the word "preferably" add --from--

Column 19, lines 52 and 53, after the word "polymer" omit the words --since the blocked polyfunctional isocyanate or a blocked prepolymer--.

Column 19, line 54, the word "ability" should be --stability--.

UNITED STATES PATENT OFFICE

CERTIFICATE OF CORRECTION

Patent No. 4,144,027 Dated March 13, 1979

Inventor(s) Emile E. Habib

It is certified that error appears in the above-identified patent and that said Letters Patent are hereby corrected as shown below:

Column 21, lines 19 and 20, after the word "of" omit --coreactive ingredients after which are added varying amounts of--.

Column 21, line 63, omit the letter "b" at beginning of line.

Column 23, line 5, "10.0" should be --10.1--.

Column 24, just below the end of TABLE III-continued, insert the footnote -- MOCA is the tradename for 4,4'-methylene-bis-(2-chloroaniline)--.

Column 27, TABLE VII-continued, second column of table, line 6, "PEG - 20.000" should be --PEG - 20,000--.

UNITED STATES PATENT OFFICE
CERTIFICATE OF CORRECTION

Patent No. 4,144,027 Dated March 13, 1979

Inventor(s) Emile E. Habib

It is certified that error appears in the above-identified patent and that said Letters Patent are hereby corrected as shown below:

Column 27, TABLE VII-continued, second column of table, line 7, "PEG - 20.000" should be --PEG - 20,000--.

Column 32, line 56, "1300" should be --1800--.

Column 32, line 58, "5000" should be --5.3--.

Column 34, line 47, change "batch" to --bath--.

Columns 35 and 36, TABLE XV, column 3 (heading), delete "Pressing Cycle (sec.)". Columns 4 and 5 (heading), over Steam Bake delete "Additional" and insert therefor --Pressing Cycle (sec.)--. Column 6 (heading) over Cure (min) delete "Before Testing" and insert therefor --Additional--. Column 7 (heading) over (hours) and beneath Ageing Time insert

UNITED STATES PATENT OFFICE
CERTIFICATE OF CORRECTION

Patent No. 4,144,027 Dated March 13, 1979

Inventor(s) Emile E. Habib

It is certified that error appears in the above-identified patent and that said Letters Patent are hereby corrected as shown below:

--Before Testing--. Column 7, line 10, delete "$\frac{1}{4}$4.0 and insert --$\frac{1}{4}$--. Column 8, line 10, insert --4.0--.

Signed and Sealed this

*Twenty-eighth* Day of *October 1980*

[SEAL]

*Attest:*

SIDNEY A. DIAMOND

*Attesting Officer*

*Commissioner of Patents and Trademarks*